US009879911B2

(12) United States Patent
Natsume

(10) Patent No.: US 9,879,911 B2
(45) Date of Patent: Jan. 30, 2018

(54) COAT DRYING DEVICE AND COAT DRYING METHOD

(71) Applicant: Nissan Motor Co., Ltd., Yokohama-shi, Kanagawa (JP)

(72) Inventor: Tomoyuki Natsume, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 15/523,687

(22) PCT Filed: Nov. 20, 2014

(86) PCT No.: PCT/JP2014/080767
§ 371 (c)(1),
(2) Date: May 2, 2017

(87) PCT Pub. No.: WO2016/079846
PCT Pub. Date: May 26, 2016

(65) Prior Publication Data

US 2017/0314857 A1 Nov. 2, 2017

(51) Int. Cl.
*F26B 7/00* (2006.01)
*F26B 21/12* (2006.01)
(Continued)

(52) U.S. Cl.
CPC ..... *F26B 21/12* (2013.01); *B05C 9/14* (2013.01); *F26B 3/04* (2013.01); *F26B 15/12* (2013.01); *F26B 2210/12* (2013.01)

(58) Field of Classification Search
CPC ..... F26B 3/283; F26B 15/16; F26B 2210/12; F26B 15/12; F26B 21/12; F26B 3/04; B05C 9/14
(Continued)

(56) References Cited

U.S. PATENT DOCUMENTS 4,241,646 A * 12/1980 Tsuruta ..... B05B 15/1222 118/326
4,416,068 A * 11/1983 Nilsson ..... B05D 3/0263 118/642
(Continued)

FOREIGN PATENT DOCUMENTS

CN 102271784 A * 12/2011 ..... B01D 46/2403
JP 64-48169 U 3/1989
(Continued)

*Primary Examiner* — Kenneth Rinehart
*Assistant Examiner* — Bao D Nguyen
(74) *Attorney, Agent, or Firm* — Global IP Counselors, LLP

(57) ABSTRACT

A coat drying device dries a coated film that is coated on a continuously transported coating object having first and second parts, where the second part has a greater heat capacity than the first part. The coat drying device includes a drying furnace, a hot air supply device and a control unit. The coating object is conveyed inside of the drying furnace main body. The hot air supply device heats the coating object by blowing hot air to the drying furnace. The control unit controls the hot air supply device based on a heat capacity of the coating object. The control unit controls the hot air supply device such that, when heating the second part, hot air with a greater amount of heat is supplied to the second part than an amount of heat in the hot air that is supplied to heat the first part.

9 Claims, 16 Drawing Sheets

(51) Int. Cl.
*B05C 9/14* (2006.01)
*F26B 3/04* (2006.01)
*F26B 15/12* (2006.01)

(58) Field of Classification Search
USPC ..... 34/311
See application file for complete search history.

(56) References Cited

U.S. PATENT DOCUMENTS 4,664,061 A * 5/1987 Morioka ..... B05B 15/1207 118/326
4,771,552 A * 9/1988 Morioka ..... F26B 15/12 34/222
4,849,598 A * 7/1989 Nozaki ..... B05D 3/0281 118/642
4,908,231 A * 3/1990 Nelson ..... F26B 3/283 118/642
5,144,754 A * 9/1992 Persson ..... F26B 21/06 34/233
5,456,023 A * 10/1995 Farnan ..... F26B 9/06 239/71
6,146,264 A * 11/2000 Tong ..... B05B 15/1207 454/52
6,736,016 B1 * 5/2004 Tong ..... G01F 1/206 118/719
6,895,689 B2 * 5/2005 Ueno ..... F26B 3/283 34/270
8,997,374 B2 * 4/2015 Sato ..... F26B 3/30 118/642
9,423,179 B2 * 8/2016 Wieland ..... F26B 15/14
2006/0055091 A1 * 3/2006 Doll ..... F26B 15/12 266/78
2007/0235437 A1 * 10/2007 Klobucar ..... F26B 15/14 219/388
2009/0130828 A1 * 5/2009 Chen ..... H01L 29/0619 438/495
2013/0061489 A1 * 3/2013 Sato ..... F26B 3/283 34/267
2014/0020258 A1 * 1/2014 Hihn ..... F26B 15/12 34/241
2015/0121720 A1 * 5/2015 Wieland ..... F26B 15/14 34/493

FOREIGN PATENT DOCUMENTS

JP 6448169 U * 3/1989
JP 8-4147 Y2 2/1996
JP 08004147 Y * 2/1996
JP 2522084 Y * 10/1996
JP 2522084 Y2 10/1996
JP 11-290751 A 10/1999
JP 11290751 A * 10/1999
JP 2000-70822 A 3/2000
JP 2000-84464 A 3/2000
JP 2000070822 A * 3/2000
JP 2000084464 A * 3/2000
JP 5477514 B2 2/2014
JP 5477514 B2 * 4/2014 ..... F26B 3/347
WO 2009/016439 A1 2/2009
WO WO 2009016439 A1 * 2/2009 ..... F26B 3/28
WO 2011/148955 A1 12/2011
WO WO 2011148955 A1 * 12/2011 ..... F26B 3/283

* cited by examiner

COAT DRYING DEVICE AND COAT DRYING METHOD

CROSS-REFERENCE TO RELATED APPLICATIONS

This application is a U.S. National stage application of International Application No. PCT/JP2014/080767, filed Nov. 20, 2014.

BACKGROUND

Field of the Invention

The present invention relates to a coat drying device and a coat drying method.

Background Information

A conventional technology is known in which, in a coat drying furnace provided in a line in which different types of workpieces with different baking temperatures are mixed, different types of workpieces are respectively collected as lots (made into lots) and fed, the workpieces are heated by a hot air circulation mechanism with respect to workpieces that have the lowest baking temperatures, and the workpieces are heated by a combined use of a hot air circulation mechanism and a far infrared mechanism with respect to workpieces that have higher baking temperatures (refer to Japanese Laid-Open Patent Application No. 2000-84464).

SUMMARY

Bake-cured paint is used for workpieces such as metal vehicle bodies and resin bumpers, where, in intermediate coating and top coating, maintaining 140° C. for 20 minutes is the standard for assuring the quality of the cured coated film. However, if a metal vehicle body and a resin bumper are mounted on the same coating platform with respect to the above-described conventional coat drying furnace with the aim of maintaining color matching and the production sequence, since the heat-up times are different due to differences in the material (heat capacity), there is the problem that if the workpiece with the relatively long heat-up time is heated so as to satisfy the quality assurance standard described above, the workpiece with the relatively short heat-up time will consume excess energy.

The problem to be solved by the present invention is to provide a coat drying device and a coat drying method that are able to achieve energy conservation when drying coated film that is coated on a plurality of coating objects with different heat capacities at the same time.

In order to solve the problem described above, in the present invention, coating objects that include a first part and a second part, which has a heat capacity that is greater than the heat capacity of the first part, are transported by the same coating platform, and upon heating the coating objects by blowing hot air thereon, when heating the second part, hot air, with a greater amount of heat than the amount of heat of the hot air that is supplied when heating the first part, is supplied deviated from the first part to the second part.

According to the present invention, if the first part and the second part are mounted on the same coating platform, although the distance therebetween will become relatively short, the difference between the heat-up time of the first part and the heat-up time of the second part is suppressed by deviating the flow direction of the hot air from the first part to the second part, and supplying hot air with a greater amount of heat than the amount of heat in the hot air that is supplied for heating the first part. It is thereby possible to suppress excess heat energy from being consumed by the first part, and to achieve energy conservation.

DETAILED DESCRIPTION OF THE EMBODIMENTS

The following embodiment is a preferred embodiment of the present invention, which will be described using a topcoat drying device 1 to which are applied the coat drying device and coat drying method of the present invention; however, the coat drying device and coat drying method of the present invention may be applied to an intermediate coat drying device, or an intermediate/topcoat drying device described further below.

The topcoat drying device 1 of the present embodiment is one of the devices that constitute a coating line PL and is a device for drying the topcoat coated film that is applied to a coating object B while transporting the coating object B, which is mounted on a coating platform 50. In the following description, first, an overview of the coating line PL and the manufacturing line of an automobile will be described, after which the coating object B and the topcoat drying device 1 will be described in detail.

The manufacturing line of an automobile is primarily configured from four lines: a press molding line PRL, a vehicle body assembly line (also called a welding line) WL, a coating line PL, and a vehicle assembly line (also called an outfitting line) ASL. In the press molding line PRL, various panels that configure a vehicle body B1 are each press-molded and transported to the vehicle body assembly line WL in a state as single pressed articles. In the vehicle body assembly line WL, a subassembly is assembled for each part of a vehicle body, such as the front body, the center floor body, the rear floor body, and the side bodies, welding is applied to predetermined sites of the assembled front body, center floor body, and rear floor body to assemble the underbody, and the side bodies and a roof panel are welded to the underbody to assemble the body shell main body B2 (the body shell excluding lids). Finally, lid components, such as a hood F, side doors D1, D2, and a back door BD (or trunk lid), which are pre-assembled, are mounted to the body shell main body B2 via hinges. Then, the body shell is transported to the vehicle assembly line ASL via the coating line PL, and various auto parts such as the engine, transmission, suspension system, and interior parts are assembled to the coated body shell.

In addition, the above-described manufacturing line of an automobile comprises a resin member molding line in addition to the four lines described above. In the resin member molding line, resin members, such as the bumper, air spoiler, door mirror covers, front grill, various finishers, and door fasteners, are molded by injection molding, press molding, etc., and the finished resin members are washed and dried, after which surface preparation is carried out, in which a conductive primer or the like is applied to the resin members.

Figure 1A:
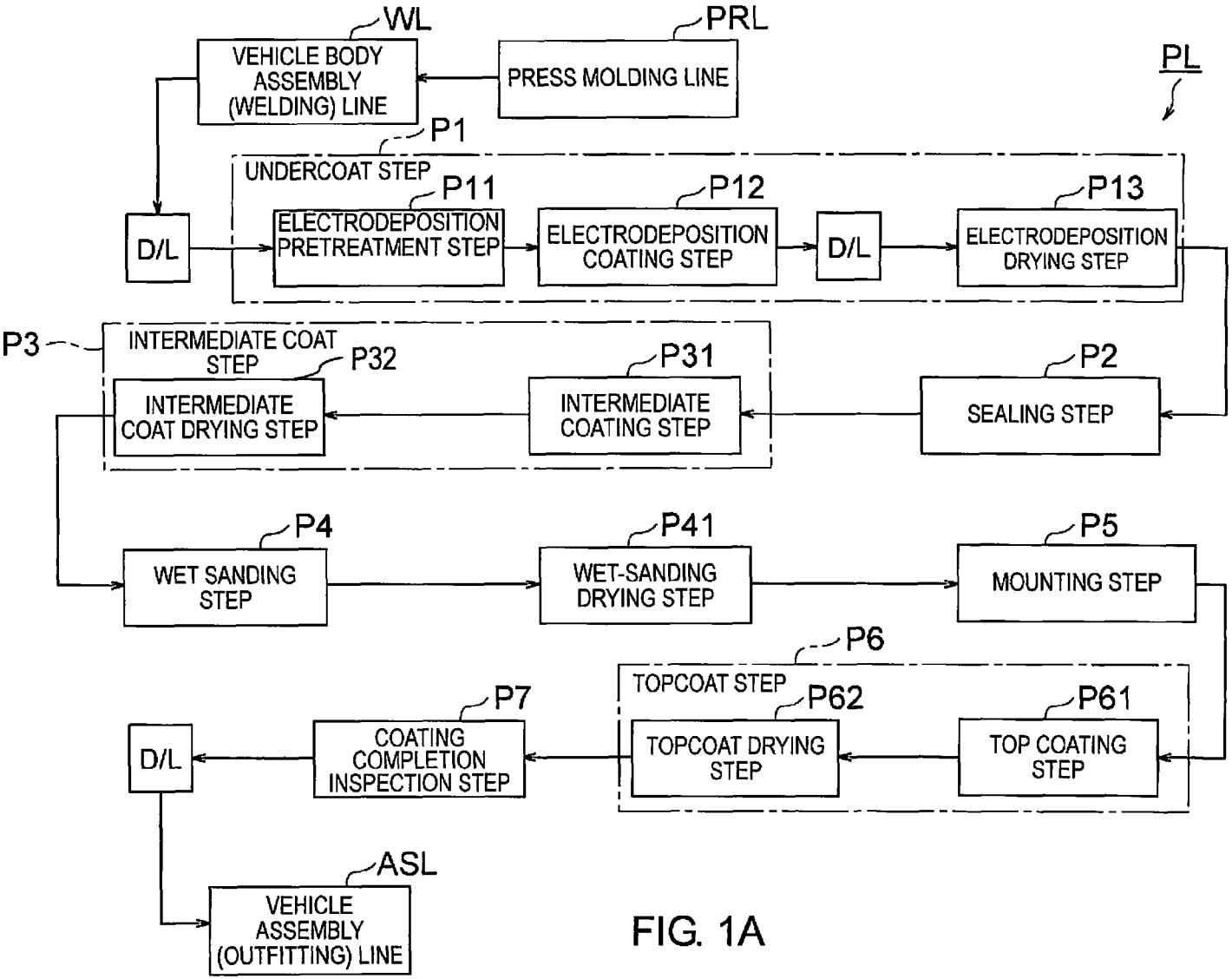
FIG. 1A is an overall process view illustrating one example of a coating line to which is applied one embodiment of the topcoat drying device according to the present invention.
Figure 1B:
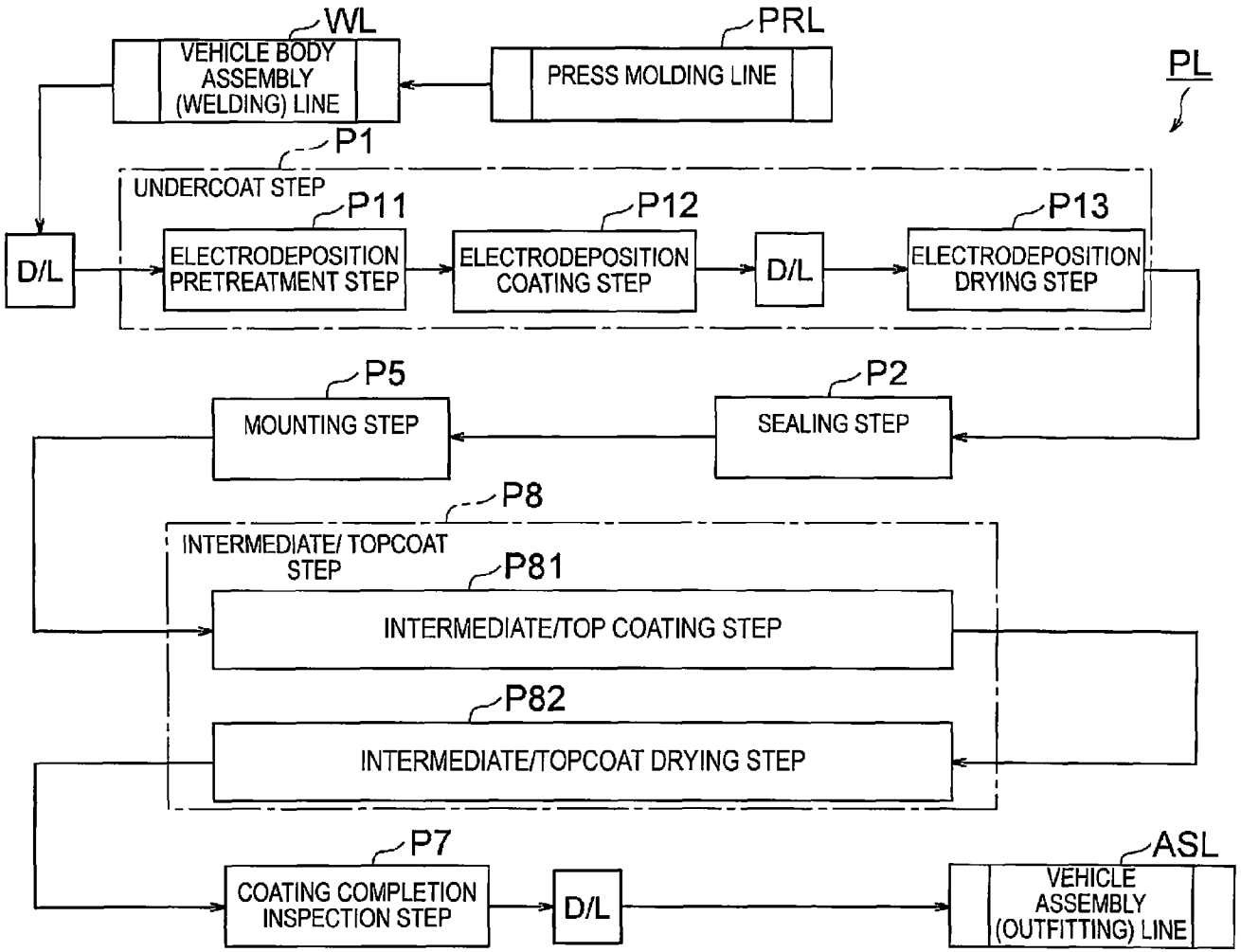
FIG. 1B is an overall process view illustrating another example of a coating line to which is applied one embodiment of the topcoat drying device according to the present invention.

Next, the main configuration of the coating line PL will be described. FIG. 1A and FIG. 1B are both overall process views illustrating examples of a coating line PL comprising a topcoat drying device to which the coat drying device and method according to the present invention are applied. The coating line PL of the embodiment illustrated in FIG. 1A is a coating line according to a three-coat three-bake coating method, said coats comprising an undercoat, an intermediate coat, and a topcoat. In contrast, the coating line PL of the embodiment illustrated in FIG. 1B is a coating line according to a three-coat two-bake coating method, in which the intermediate coating and the top coating are coated in the same coating booth using a wet-on-wet process (application of a coating onto an uncured coated film; hereinafter, same), and the intermediate coated film and the top coated film are baked at the same time in the same coat drying furnace. In this manner, the coat drying device and method of the present invention can be applied to any coating line having different coating methods. The coat drying device and method according to the present invention can be applied to modifications of the three-coat three-bake coating method or the three-coat two-bake coating method, such as a four-coat coating method in which the intermediate coat is applied twice, or when the topcoat color is a special two-tone color by modifying a part of these types of typical coating lines PL. The coating lines of FIG. 1A and FIG. 1B are described below in parallel; common configurations are denoted by the same reference symbols and are described with reference to the coating line of FIG. 1A, and any differences between the configurations of the two coating lines of FIG. 1A and FIG. 1B will be described with reference to FIG. 1B.

The coating line PL of the embodiment illustrated in FIG. 1A comprises an undercoat Step P1, a sealing Step P2, an intermediate coat Step P3, a wet sanding Step P4, a mounting Step P5, a topcoat Step P6, and a coating completion inspection Step P7. In contrast, the coating line PL of the embodiment illustrated in FIG. 1B comprises an undercoat Step P1, a sealing Step P2, a mounting Step P5, an intermediate/topcoat Step P8, and a coating completion inspection Step P7. That is, in the coating line PL of FIG. 1B, the two steps of the intermediate coating Step P31 and the topcoating Step P61 illustrated in FIG. 1A are carried out in a single step, i.e., the intermediate/topcoating Step P81, in FIG. 1B; similarly, the two steps of the intermediate coat drying Step P32 and the topcoat drying Step P62 illustrated in FIG. 1A are carried out in a single step, i.e., the intermediate/topcoat drying Step P82 of FIG. 1B. The intermediate/topcoat Step P8 of FIG. 1B will be described further below.

The undercoat Step P1 comprises an electrodeposition pretreatment Step P11, an electrodeposition coating Step P12, and an electrodeposition drying Step P13, as illustrated in FIG. 1A and FIG. 1B. In the electrodeposition pretreatment Step P11, vehicle bodies B1 (white body) that are transferred from a platform of the vehicle body assembly line WL to a coating hanger (not shown) by a drop lifter D/L are continuously conveyed at a predetermined pitch and a predetermined conveying speed by an overhead conveyor. The configuration of the vehicle body B1 will be described further below.

While not shown, the electrodeposition pretreatment Step P11 comprises a degreasing step, a washing step, a surface conditioning step, a chemical film forming step, a washing step, and a draining step. Since press oil, as well as iron powder due to welding and other dust particles, adhere to the vehicle body B1 that is conveyed onto the coating line PL in the press molding line PRL and the vehicle body assembly line WL, such matter is washed and removed in the degreasing step and the washing step. In the surface conditioning step, the surface of the vehicle body B1 is caused to adsorb surface conditioner components in order to increase the number of reaction origin points in the next step, the chemical film forming step. The adsorbed surface conditioner components become the nucleus of film crystals and accelerate the film formation reaction. In the chemical film forming step, chemical film is formed on the surface of the vehicle body B1 by immersing the vehicle body B1 into a chemical conversion treatment solution such as zinc phosphate. In the washing step and the draining step, the vehicle body B1 is washed and dried.

In the electrodeposition coating Step P12, vehicle bodies B1 to which pretreatment has been applied by the electrodeposition pretreatment Step P11 are continuously conveyed at a predetermined pitch and a predetermined conveying speed by an overhead conveyor. Then, the vehicle body B1 is immersed in a boat-shaped electrodeposition bath filled with electrodeposition coating, and a high voltage is applied between a plurality of electrode plates provided inside the electrodeposition bath and the vehicle body B1 (specifically, a coating hanger that has electrical conductivity). An electrodeposition film is thereby formed on the surface of the vehicle body B1 due to the electrophoresis action of the electrodeposition coating. An example of electrodeposition coating is a thermoset coating having an epoxy resin, such as polyamine resin, as the base resin. Although, from the standpoint of rust prevention, it is preferable that this electrodeposition coating be a cationic electrodeposition coating, in which a positive high voltage is applied to the electrodeposition coating side, an anionic electrodeposition coating, in which a positive high voltage is applied to the vehicle body B1 side, may also be used.

The vehicle body B1 that has been taken out of the electrodeposition bath of the electrodeposition coating Step P12 is conveyed to the washing step, and electrodeposition coating that has adhered to the vehicle body B1 is washed away using industrial water or pure water. At this time, the electrodeposition coating that is taken out from the electrodeposition bath when the vehicle body is removed from the tank is also recovered in this washing step. When the washing treatment is completed, undried electrodeposition film with a film thickness of 10 μm-35 μm will be formed on the surface as well as within the pocket structures of the vehicle body B1. When the electrodeposition coating Step P12 is completed, the vehicle body B1 that is mounted on the coating hanger is transferred onto the coating platform 50 by the drop lifter D/L. It is also possible to dispose the drop lifter D/L, which is disposed between the electrodeposition coating Step P12 and the electrodeposition drying Step P13 illustrated in FIG. 1A and FIG. 1B, between the electrodeposition drying Step P13 and the sealing Step P2, and the vehicle body may be conveyed in the electrodeposition drying Step P13 in a state of being mounted on the coating hanger. The coating platform 50 of the present embodiment will be described below.

In the electrodeposition drying Step P13, vehicle bodies B1 that are mounted on the coating platform 50 are continuously conveyed at a predetermined pitch and a predetermined conveying speed by a floor conveyor. The vehicle body is then baked and dried, for example, by holding a temperature of 160° C.-180° C. for 15-30 minutes, thereby forming dried electrodeposition film with a film thickness of 10 μm-35 μm on the inner and outer panels as well as within the pocket structures of the vehicle body B1. Although the coating platform 50, on which are mounted the vehicle bodies B1, is continuously conveyed by the floor conveyor from the electrodeposition drying Step P13 to the coating completion inspection Step P6, the conveying pitch and the conveying speed of the coating platform 50 in each step is in accordance with that step. Accordingly, the floor conveyor is configured from a plurality of conveyors, and the conveying pitch and the conveying speed for each step are set to predetermined values.

In the present Specification and Claims, a reference to a "coating," such as the electrodeposition coating, intermediate coating, and top coating, refers to the liquid state before applying onto a coating object, and a reference to a "coated film," such as the electrodeposition film, intermediate coated film, and top coated film, refers to a film-like undried (wet) or dried state after being coated on the coating object, and the two are distinguished. In addition, in the present Specification and Claims, the upstream side and the downstream side refer to upstream and downstream relative to the conveyance direction of the vehicle body B1 (coating object B). In addition, in the present Specification, conveying the vehicle body B1 (coating object B) in a forward-looking manner means to convey along the longitudinal axis of the vehicle body with the front portion of the vehicle body B1 on the front side of the conveyance direction and the rear portion of the vehicle body on the rear side; conveying the vehicle body B1 in a rearward-looking manner means the opposite, that is, conveying along the longitudinal axis of the vehicle body with the rear portion of the vehicle body B1 on the front side of the conveyance direction and the front portion of the vehicle body on the rear side. In the undercoat Step P1—coating completion inspection Step P7 of the present embodiment, the vehicle body B1 may be conveyed in a forward-looking manner or in a rearward-looking manner.

In the sealing Step P2 (including an undercoat step and a stone guard coat step), vehicle bodies B1 on which electrodeposition film has been formed are conveyed, and vinyl chloride-based resin sealing material is applied to the steel plate seams and the steel plate edges for the purpose of sealing and rust prevention. In the undercoat step, a vinyl chloride resin-based chipping-resistant material is applied to the tire house and the backside of the floor of the vehicle body B1. In the stone guard coat step, chipping-resistant material made of polyester or polyurethane resin is applied to outer panel bottom portion of the body, such as the side sills, fender, doors, etc. These sealing materials and chipping-resistant materials will be cured in a dedicated drying step or in the intermediate coat drying Step P32 described next.

The intermediate coat Step P3 of the coating line PL of FIG. 1A comprises an intermediate coating Step P31 and an intermediate coat drying Step P32. In the intermediate coating Step P31, vehicle bodies B1 to which electrodeposition film has been formed are conveyed to an intercoating booth, and an inner panel coating paint, to which is added coloring pigment corresponding to the outer panel color of the vehicle, is applied to the inner panel portions of the vehicle body, such as the engine compartment, hood inner, back door inner, etc., inside the intercoating booth. Then, intermediate coating is applied to the outer panel portions, such as the hood outer, roof outer, door outer, back door outer (or trunk lid outer), etc., by a wet-on-wet process on the inner panel coating film. The outer panel portions are visible portions of a finished vehicle which has completed the outfitting step, and the inner panel portions are portions that are not visible from the outside of the finished vehicle.

In the intermediate coat drying Step P32 of the coating line PL of FIG. 1A, the vehicle body B1 is conveyed to an intermediate coat drying device. The undried intermediate coated film is then baked and dried, for example, by holding a temperature of 130° C.-150° C. for 15-30 minutes, thereby forming intermediate coated film with a film thickness of 15 μm-35 μm on outer panel portions of the vehicle body B1. In addition, inner panel coating film with a film thickness of 15 μm-30 μm is formed on the inner panel portions of the vehicle body B1. The inner panel coating paint and the intermediate coating are thermoset coatings that have acrylic resin, alkyd resin, polyester resin, etc., as a base resin, and may be either a water-based coating or an organic solvent-based coating.

In the wet sanding Step P4 of the coating line PL of FIG. 1A, vehicle bodies B1 that have completed up to the intermediate coat Step P3 are conveyed, and the surface of the intermediate coated film that has been formed on the vehicle body B1 is polished using clean water and a polishing agent. The coating adhesion between the intermediate coated film and the top coated film is thereby improved, and the smoothness (coated skin and clarity) of the top coated film of the outer panel portions is improved. This wet sanding Step P4 comprises a wet-sanding drying Step P41, and in this wet-sanding drying Step P41, moisture that is adhered to the vehicle body B1 is dried by the vehicle body B1 passing through a draining and drying furnace.

In the mounting Step P5 of the coating line PL of FIG. 1A, the resin member (the bumper BP in the present embodiment) that is molded in the above-described resin member molding line is mounted on the coating platform 50, which conveys the vehicle body B1. A bumper BP that has been completed up to the surface preparation is subjected to finish coating (top coating) together with the vehicle body B1 in the subsequent topcoat Step P6. The bumper BP will be described in detail below.

The topcoat Step P6 of the coating line PL of FIG. 1A comprises a top coating Step P61 and a topcoat drying Step P62. In the top coating Step P61, the coating objects B are conveyed, including the bumper BP and the vehicle body B1, which have passed through the wet sanding Step P4 and the wet-sanding drying Step P41. Then, in the topcoating booth, a topcoat base paint is applied to the outer panel portions of the coating objects B, and then a topcoat clear paint is applied to the outer panel portions of the coating objects B by a wet-on-wet process on this topcoat base paint.

The topcoat base paint and the topcoat clear paint are coatings that have acrylic resin, alkyd resin, polyester resin, etc., as a base resin and may be either a water-based coating or an organic solvent-based coating. The topcoat base paint is coated by being diluted to about 80% by weight ratio (solid content about 20%-40%), with consideration to the finish qualities, such as the orientation of the luster pigment; in contrast, the topcoat clear paint is coated by being diluted to about 30% by weight ratio (solid content about 70%-80%). However, the coating solid content of the topcoat base paint generally rises to 70% or greater in the flash-off step after coating (a stationary process in which solvents are allowed to evaporate naturally inside a booth).

The outer panel color of the coating object B of the present embodiment is a metallic outer panel comprising various luster pigments such as aluminum, mica, etc., and a topcoat base paint and a topcoat clear paint are applied to the coating object B, but no limitation is imposed thereby. For example, the outer panel color of the coating object B may be a solid outer panel color. A solid outer panel color is a coating color that does not include luster pigment, and in this case, a topcoat base paint is not applied, and a topcoat solid paint is applied instead of the topcoat clear paint. Examples of such topcoat solid paint include coatings that have the same base resin as the topcoat base paint and the topcoat clear paint.

In the topcoat drying Step P62 of the present embodiment, coating objects B to which have been applied the top coating in the topcoating booth are conveyed to the topcoat drying device 1. In this topcoat drying Step P62, coating objects pass through the topcoat drying device 1 under a predetermined condition, and dried top coated film is thereby formed. The specific configurations of the topcoat drying device 1 and the topcoat drying Step P62 will be described further below.

The film thickness of the topcoat base film is, for example, 10 μm-20 μm, and the film thickness of the topcoat clear film is, for example, 15 μm-30 μm. If the outer panel color of the coating object B is a solid outer panel color, the film thickness of the topcoat solid film is, for example, 15 μm-35 μm. Finally, the vehicle body that has completed coating (coating completed body) is conveyed to the coating completion inspection Step P7, where various tests are carried out in order to evaluate the appearance, clarity, etc. of the coated film.

On the other hand, in the coating line PL illustrated in FIG. 1B, an intermediate/topcoat Step P8 is provided in place of the intermediate coat Step P3, the wet-sanding drying Step P4 (including the wet-sanding drying Step P41), and the topcoat Step P6 of the coating line PL illustrated in FIG. 1A. This intermediate/topcoat Step P8 of the present embodiment comprises an intermediate/top coating Step P81 and an intermediate/topcoat drying Step P82.

In the intermediate/top coating Step P81 of the coating line PL illustrated in FIG. 1B, the coating objects B, including the bumper BP and the vehicle body B1, on which an electrodeposition film has been formed, are conveyed to an intermediate/topcoat booth, and an inner panel coating paint, to which is added coloring pigment corresponding to the outer panel color of the vehicle, is applied to the inner panel portions of the vehicle body, such as the engine compartment, hood inner, back door inner, etc., in the first half zone of the intermediate/topcoat booth. Then, intermediate coating is applied to the outer panel portions, such as the hood outer, roof outer, door outer, back door outer (or trunk lid outer), etc., by a wet-on-wet process on the inner panel coating film. Coating of the intermediate coating is not carried out with respect to the bumper BP. Next, similarly in the latter half zone of the intermediate/topcoat booth, a topcoat base paint is applied to the outer panel portions of the coating objects B, including the vehicle body B1 and the bumper BP, and then a topcoat clear paint is applied to the outer panel portions of the coating objects B by a wet-on-wet process on this topcoat base paint. That is, the inner panel coating, intermediate coating, and topcoat base paint and clear paint are all coated by a wet-on-wet process and are baked and dried at the same time in one topcoat drying furnace. In order to suppress insufficient side coating and a reduction in clarity caused by overlaying wet-coated film, a flash-off step, which raises the coating NV of the wet-coated film that is applied to the coating object B, may be provided after coating the intermediate coating or after coating the topcoat base paint. The inner panel coating paint, the intermediate coating, and the topcoat base paint and clear paint that are used in this embodiment are thermoset coatings that have acrylic resin, alkyd resin, polyester resin, etc., as a base resin in the same manner as the coatings used in the coating line PL illustrated in FIG. 1A and may be either water-based coatings or organic solvent-based coatings.

Next, the coating object B in the present embodiment will be described in detail, with reference to FIG. 2A-FIG. 2D.

Figure 2A:
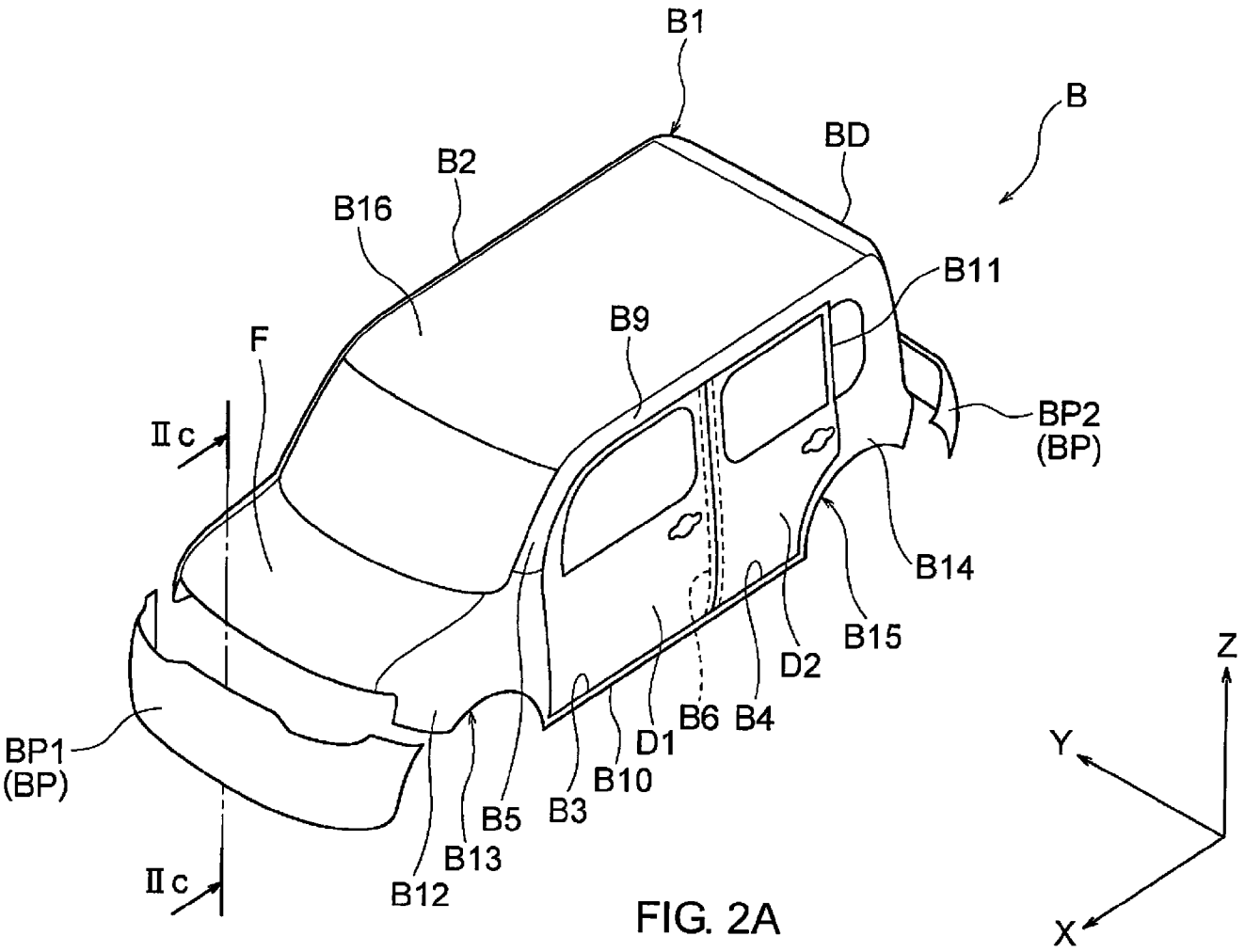
FIG. 2A is a perspective view when viewing a coating object according to one embodiment of the present invention from the front.
Figure 2B:
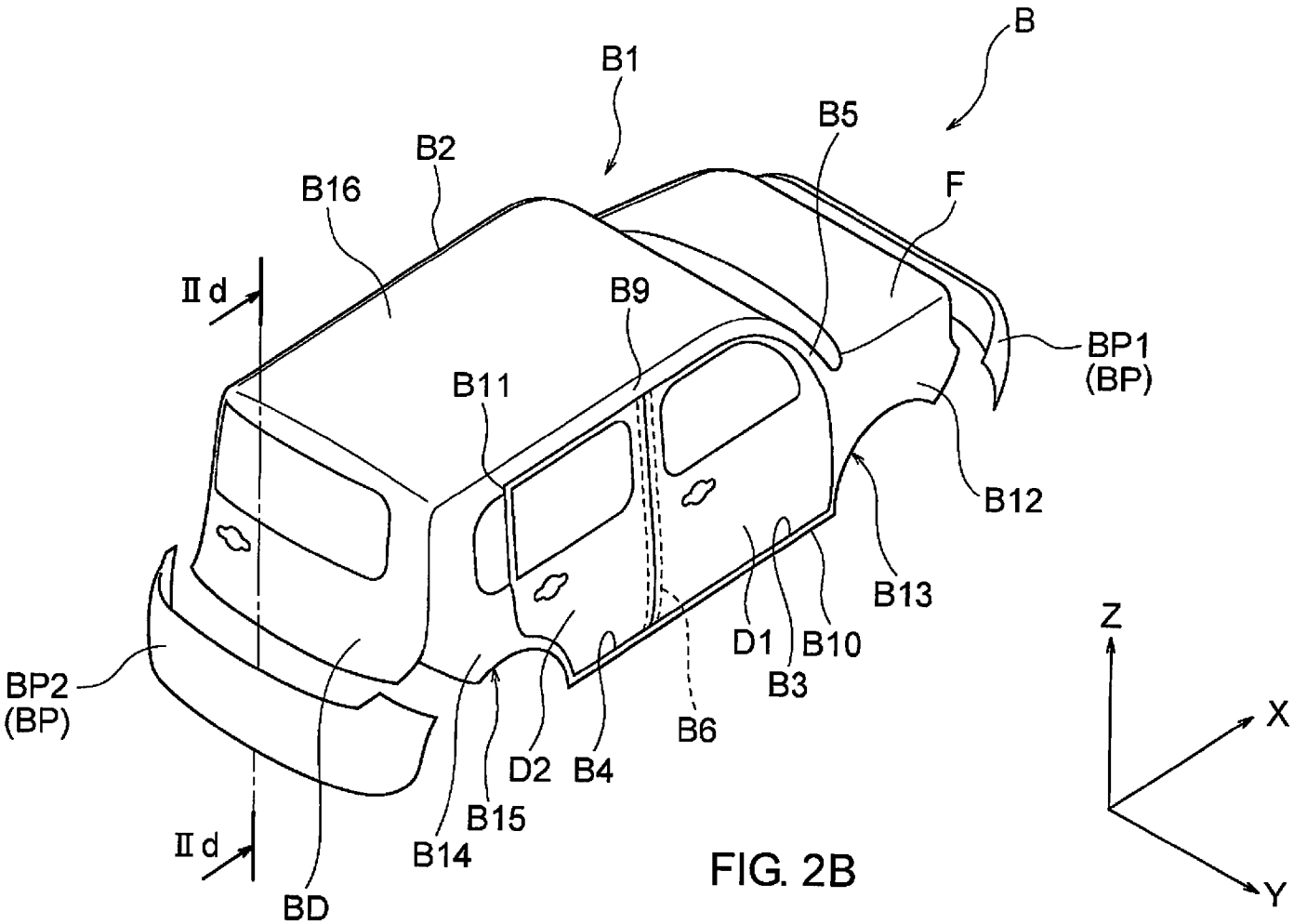
FIG. 2B is a perspective view when viewing a coating object according to one embodiment of the present invention from the rear.
Figure 2C:
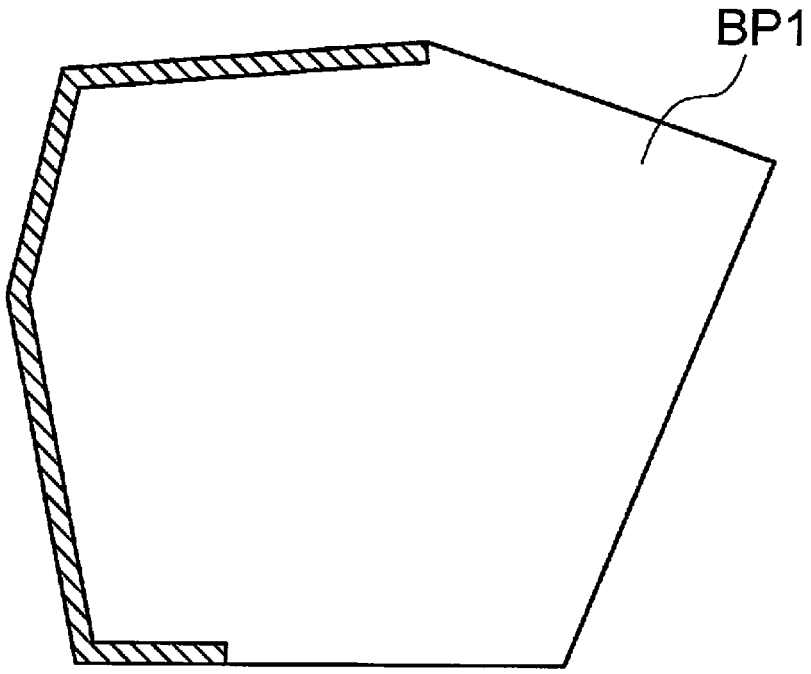
FIG. 2C is a view illustrating a front bumper according to one embodiment of the present invention, which is a cross-sectional view along line IIc-IIc of FIG. 2A.
Figure 2D:
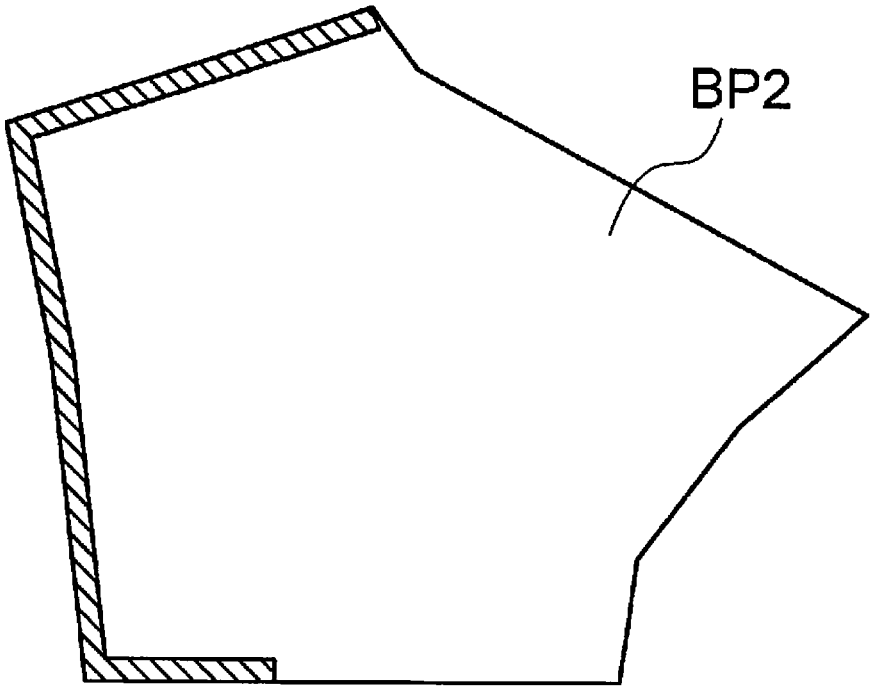
FIG. 2D is a view illustrating a rear bumper according to one embodiment of the present invention, which is a cross-sectional view along line IId-IId of FIG. 2B.

FIG. 2A is a perspective view when viewing the coating object according to one embodiment of the present invention from the front, FIG. 2B is a perspective view when viewing the coating object according to one embodiment of the present invention from the rear, FIG. 2C is a view illustrating a front bumper according to one embodiment of the present invention, which is a cross-sectional view along line IIc-IIc of FIG. 2A, and FIG. 2D is a view illustrating a rear bumper according to one embodiment of the present invention, which is a cross-sectional view along line IId-IId of FIG. 2B.

The coating object B is configured comprising a vehicle body B1 and a bumper BP, as illustrated in FIG. 2A and FIG. 2B. The vehicle body B1 of the present embodiment comprises a body shell main body B2, a hood F, front doors D1, rear doors D2, and a back door BD, which are lid components. Front door openings B3 and rear door openings B4 are formed on both sides of the body shell main body B2. The front door opening B3 is an opening that is defined by a front pillar B5, a center pillar B6, a roof side rail B9, and a side shell B10 of the body shell main body B2. The rear door opening B4 is an opening that is defined by the center pillar B6, a rear pillar B11, the roof side rail B9, and the side shell B10 of the body shell main body B2. Hereinbelow, the front door opening B3 and the rear door opening B4 may be collectively referred to as the door openings B3, 4. The back door BD, as the illustrated lid component, may be a trunk lid, depending on the vehicle type of the vehicle body B1.

Since the vehicle body B1 of the present embodiment, as illustrated, is a four-door vehicle type, the side doors D comprise a front door D1 and a rear door D2. Two-door sedans and two-door coupes have only a front door D1 and a front door opening B3 and do not have a rear door D2 or a rear door opening B4. The front door D1 of the present embodiment is disposed to correspond to the front door opening B3, and the rear door D2 is disposed to correspond to the rear door opening B4. In this manner, various lid components are attached to the body shell main body B2 of the vehicle body B1, and the production of automobiles, which are made by assembling vehicle bodies B1, is thereby made efficient. The "vehicle body B1" of the present embodiment corresponds to one example of the "first part" of the present invention.

The bumper BP is configured comprising a front bumper BP1 and a rear bumper BP2. The front bumper BP1 is a bumper provided to the front of the vehicle body of an automobile, which is made by assembling a bumper BP thereto. The front bumper BP1 extends along the width direction of the vehicle body B1 and is bridged between front fenders B12 of the vehicle body B1 via a front bumper reinforcement, which is a steel plate part, as illustrated in FIG. 2A. In addition, the two ends of the front bumper BP1 are curved along the side surface shape of the front fenders B12. A part of the curved portion of the front bumper BP1 is formed along a front wheel house B13. This front bumper BP1 is formed to be bent outward when viewed in cross section, as illustrated in FIG. 2C.

The rear bumper BP2 is a bumper provided to the rear of the vehicle body of an automobile, which is made by assembling a bumper BP thereto. The rear bumper BP2 extends along the width direction of the vehicle body B1 and is bridged between rear fenders B14 of the vehicle body B1 via a rear bumper reinforcement, which is a steel plate part, as illustrated in FIG. 2B. In addition, the two ends of the rear bumper BP2 are curved along the side surface shape of the rear fenders B14. A part of the curved portion of the rear bumper BP2 is formed along a rear wheel house B15. This rear bumper BP2 is formed to be bent outward when viewed in cross section, as illustrated in FIG. 2D. In the present embodiment, the bumper BP is a collective term for the front bumper BP1 and the rear bumper BP2. The "bumper BP" in the present embodiment corresponds to one example of the "second part" of the present invention.

The material forming the vehicle body B1 in the present embodiment is not particularly limited, and examples thereof include metal materials, such as steel, and non-ferrous metal materials, such as aluminum. In contrast, the material forming the bumper BP is not particularly limited, and examples thereof include urethane resin and polypropylene resin.

In the present embodiment, the heat capacity of the material that forms the bumper BP is relatively greater than the heat capacity of the material that forms the vehicle body B1. The heat capacity of an object is obtained by multiplying the specific heat by the weight of the material that forms the object; for example, if the material that forms the bumper BP is polypropylene, the specific heat of the polypropylene is 1930 J/(g·° C.), whereas, if the material that forms the vehicle body B1 is carbon steel, the specific heat of the carbon steel is 461 J/(g·° C.). Thus, the specific heat of polypropylene that forms the bumper BP has a value that is about four times that of the specific heat of carbon steel that forms the vehicle body B1, and given the difference between the specific heats of these materials, the heat capacity of the material that forms the bumper BP has a greater value than the heat capacity of the material that forms the vehicle body B1.

The bumper BP with a high heat capacity requires a longer time to raise the bumper BP to a predetermined temperature compared with the vehicle body B1 with a low heat capacity. In this manner, when parts that have different heat capacities (vehicle body B1 and bumper BP) are heated at the same time, if the coating object B is heated so as to satisfy the quality assurance standard of the bumper BP with a long heat-up time, the heat-up time of the vehicle body B1 will be redundant.

In the present embodiment, "heat capacity" is the amount of heat required to raise the temperature of a certain substance by 1° C. In addition, "specific heat" is the amount of heat required to raise the temperature of 1 g of a certain substance by 1° C. Here, the "amount of heat" refers to heat energy expressed as a quantity. In addition, in the present embodiment, the coating object B is a collective term for the vehicle body B1 and the bumper BP.

Next, the coating platform 50 in the present embodiment will be described in detail with reference to FIG. 3A-FIG. 3C.

Figure 3A:
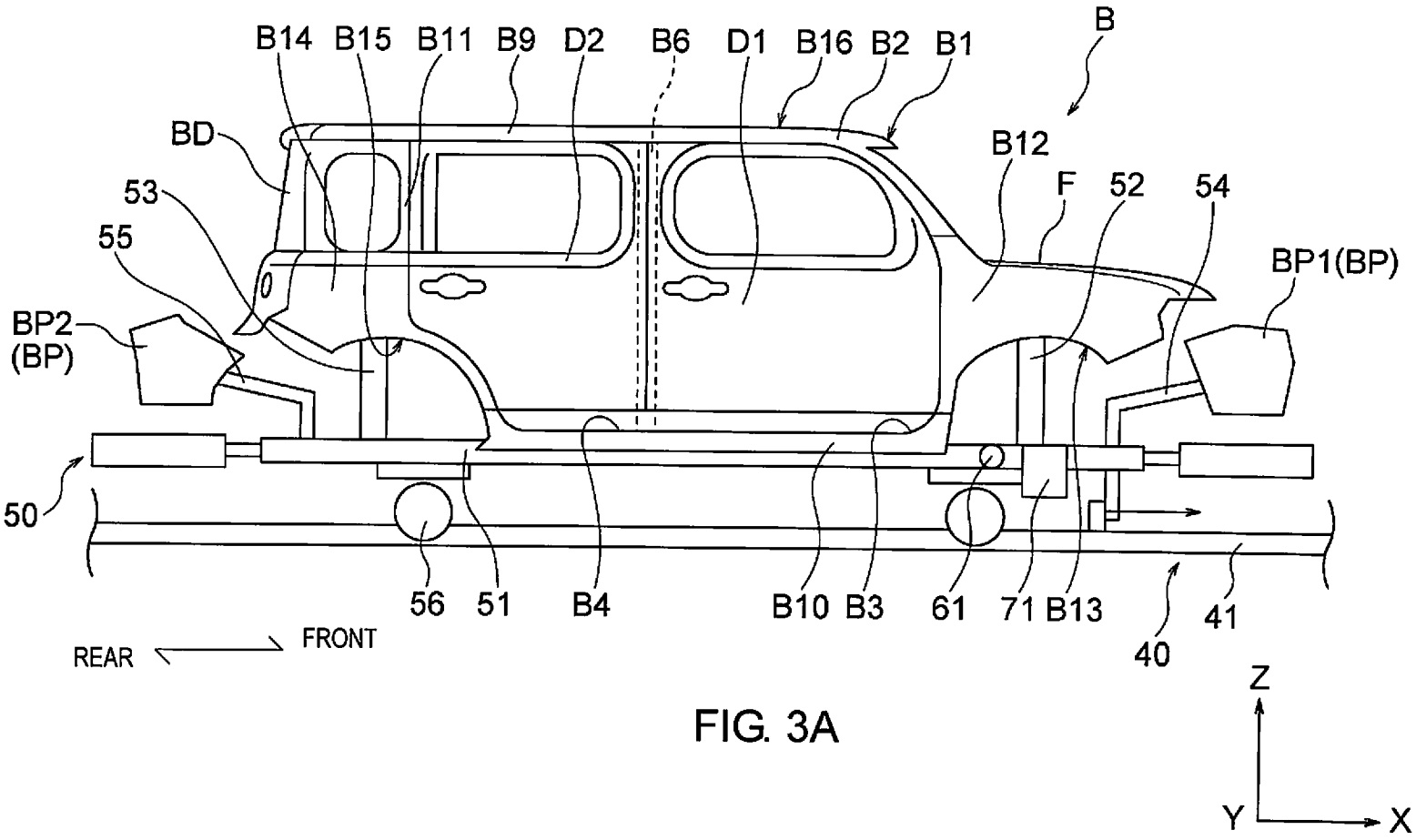
FIG. 3A is a side surface view illustrating a state in which coating objects are mounted on a transport platform according to one embodiment of the present invention.
Figure 3B:
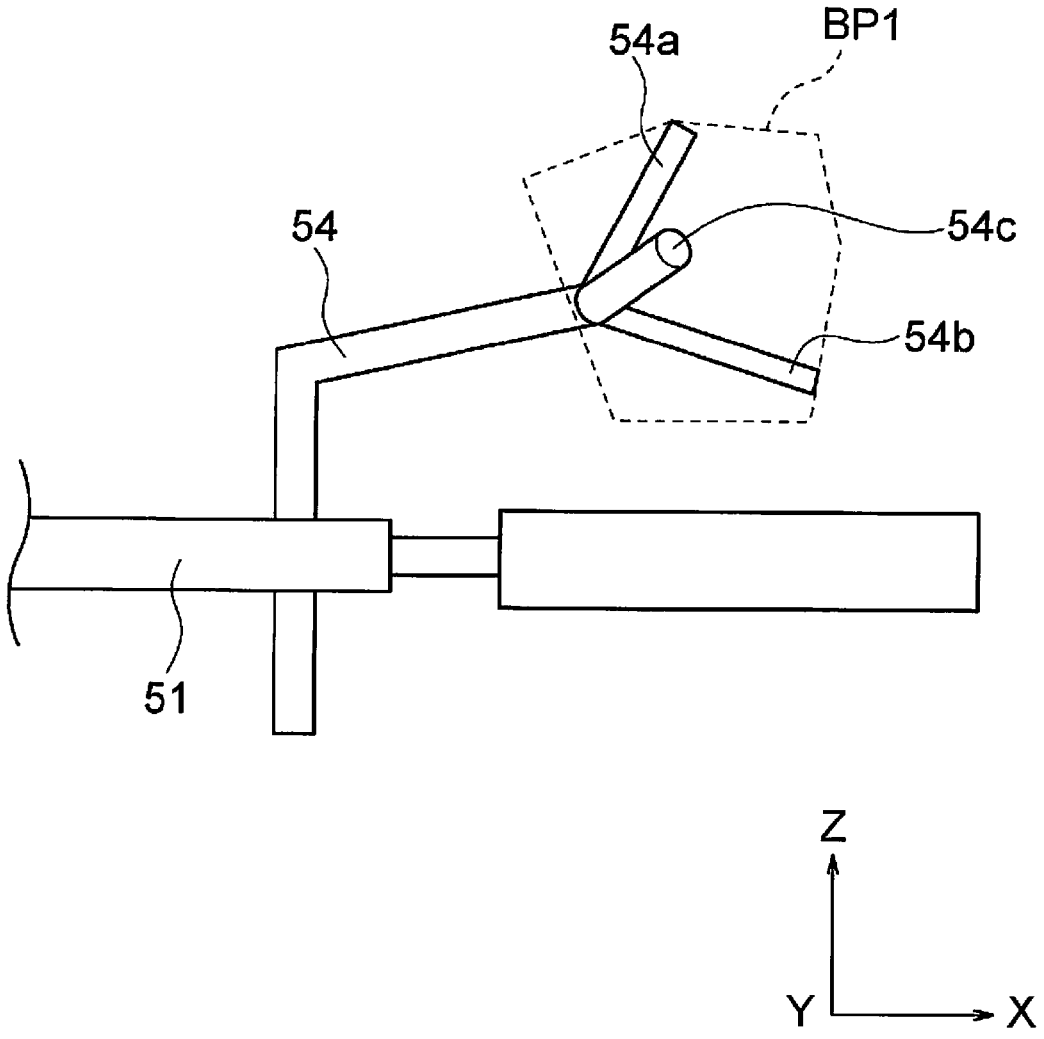
FIG. 3B is a side perspective view illustrating a state in which a front bumper is mounted on a front attachment for bumpers according to one embodiment of the present invention.
Figure 3C:
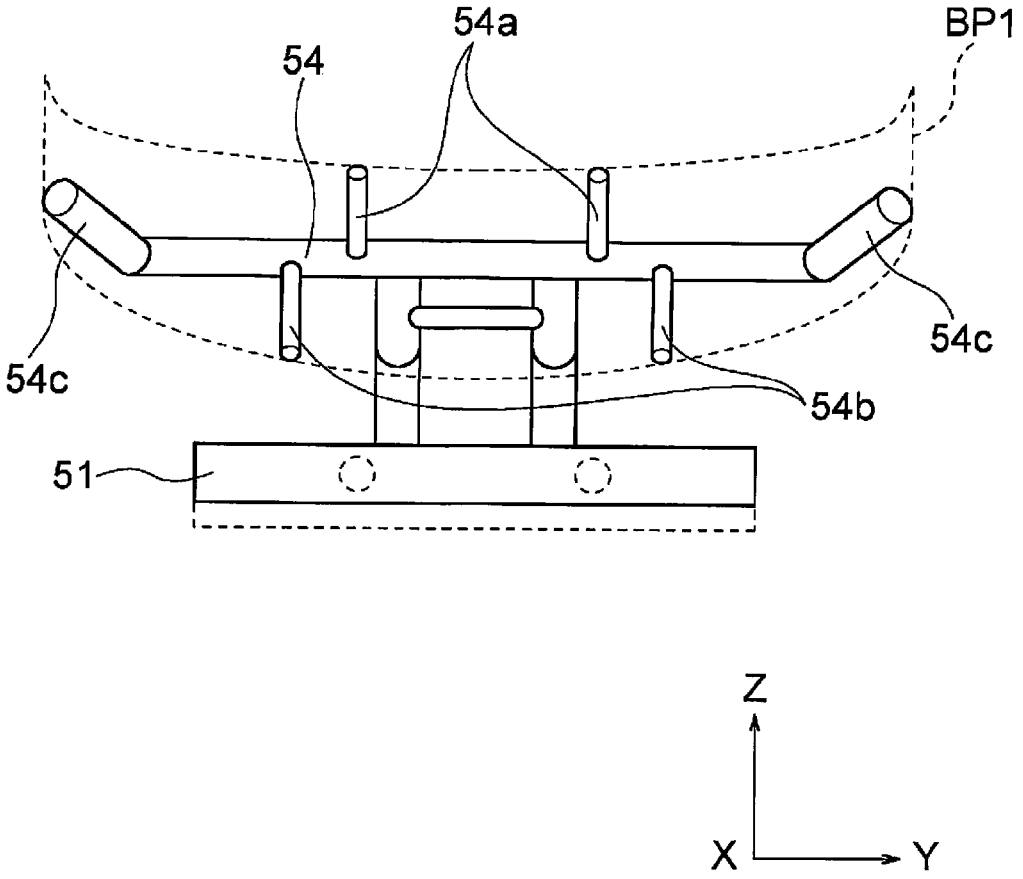
FIG. 3C is a front perspective view illustrating a state in which a front bumper is mounted on a front attachment for bumpers according to one embodiment of the present invention.

FIG. 3A is a side surface view illustrating a state in which the coating objects are mounted on a transport platform according to one embodiment of the present invention; FIG. 3B is a side perspective view illustrating a state in which a front bumper is mounted on a front attachment for bumpers according to one embodiment of the present invention; and FIG. 3C is a front perspective view illustrating a state in which a front bumper is mounted on a front attachment for bumpers according to one embodiment of the present invention.

The coating object B described above is conveyed from the electrodeposition drying Step P13 to the coating completion inspection Step P7 in FIG. 1A and FIG. 1B in a state of being mounted on the coating platform 50. The coating platform 50 of the present embodiment is a rectangular frame in plan view, and comprises a base 51 made of a rigid body that is capable of supporting a vehicle body B1, four wheels 56 that are provided to the lower surface of the base 51, two body front attachments 52 and two body rear attachments 53 provided on the upper surface of the base 51, and a bumper front attachment 54 and a bumper rear attachment 55 provided on the upper surface of the base 51, as illustrated in FIG. 3A.

The left and right body front attachments 52 respectively support the left and right front under bodies (front side members, etc.) of the vehicle body B1, and the left and right body rear attachments 53 respectively support the left and right rear under bodies (rear side members, etc.) of the vehicle body B1. These four attachments 52, 53 support the vehicle body B1 horizontally.

The bumper front attachment 54 is provided on the front side of the base 51, and the front bumper BP1 can be mounted thereon. Specifically, a plurality of supports 54*a*-54*c*, which correspond to the inner panel side shape of the front bumper BP1, are provided to the bumper front attachment 54, as illustrated in FIG. 3B and FIG. 3C. If the front bumper BP1 is attached as to cover the bumper front attachment 54, the front bumper BP1 is supported by the supports 54*a*-54*c*.

The bumper rear attachment 55 is provided on the rear side of the base 51, and the rear bumper BP2 can be mounted thereon. A plurality of supports that correspond to the inner panel side shape of the rear bumper BP2 are also provided to this bumper rear attachment 55 as well, but since the configuration is the same as the supports 54*a*-54*c* of the bumper front attachment 54 described above, the description thereof is omitted. The four wheels 56 are rotated on their axes along rails 41 that are laid on the left and right of the transport conveyor 40.

As described above, the vehicle body B1 and the bumper BP can be integrally mounted on the coating platform 50. At this time, the positional relationship among the position of the vehicle body B1 to which are attached the body attachments 52, 53, the position of the front bumper BP1 that is attached to the bumper front attachment 54, and the position of the rear bumper BP2 that is attached to the bumper rear attachment 55 preferably substantially matches the positional relationship among the position of the rear bumper BP2, the position of the front bumper BP1, and the position of the vehicle body B1 in the finished vehicle which has completed the outfitting step. By substantially matching the positional relationship of the vehicle body B1 and the bumper BP of the coating object B to the finished vehicle which has completed the outfitting step, and subjecting the vehicle body B1 and the bumper BP to top coating at the same time, it is possible to suppress the occurrence of hue shift in the top coated film between the vehicle body B1 and the bumper BP. It is thus possible to obtain an automobile with excellent appearance.

The coating platform 50 in the present embodiment is provided with contacts 62 of a position detecting sensor 60 described below on the side of the base 51. In addition, a production management transmitter 72 is provided to the side of the base 51, in which transmitter are written various production specifications of a vehicle type detecting sensor 70, described below with respect to the body.

Next, the topcoat drying device 1 in the present embodiment will be described in detail with reference to FIG. 4A-FIG. 4D.

Figure 4A:
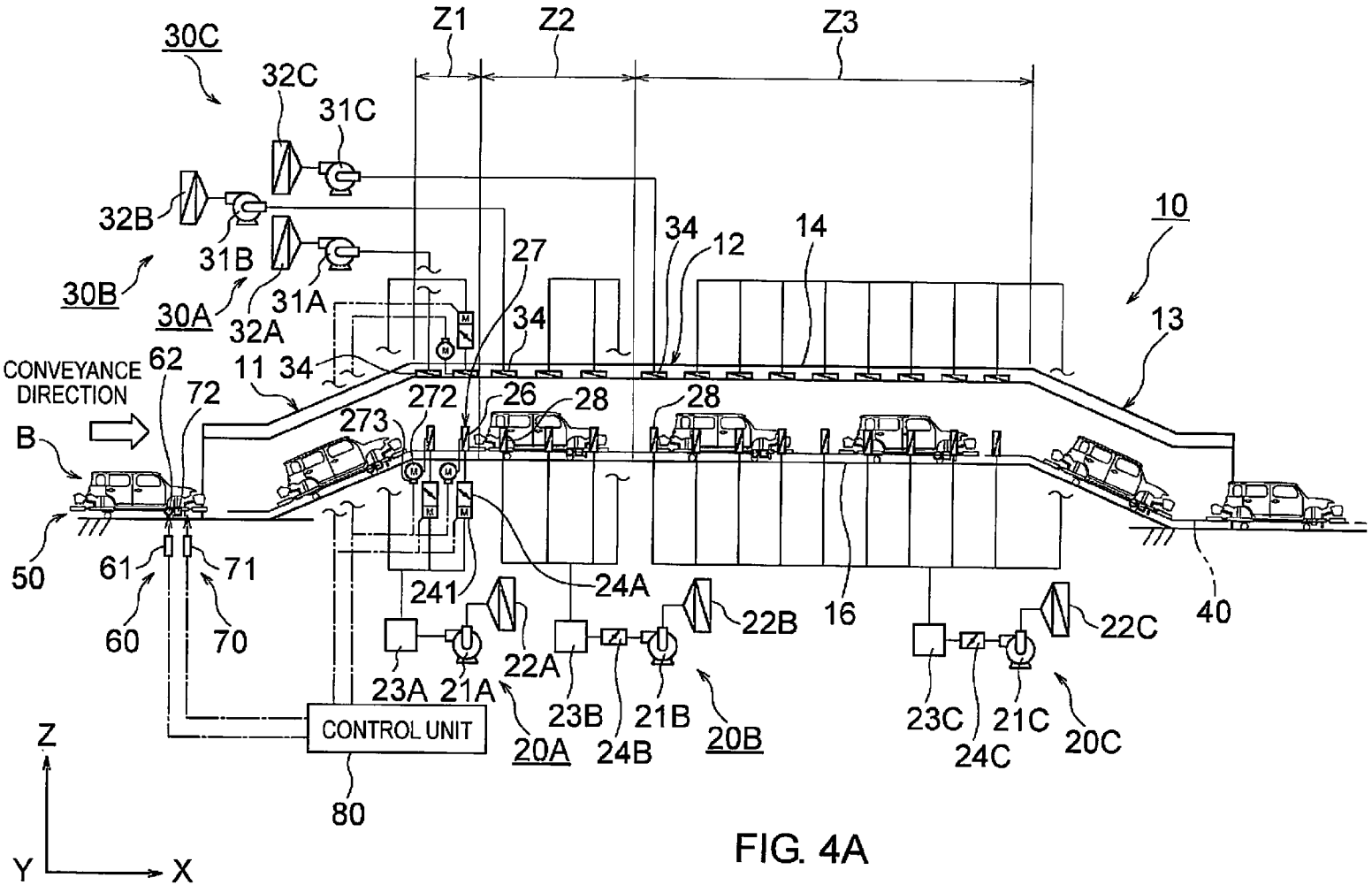
FIG. 4A is a side surface view illustrating a schematic overview of a topcoat drying device according to one embodiment of the present invention.
Figure 4B:
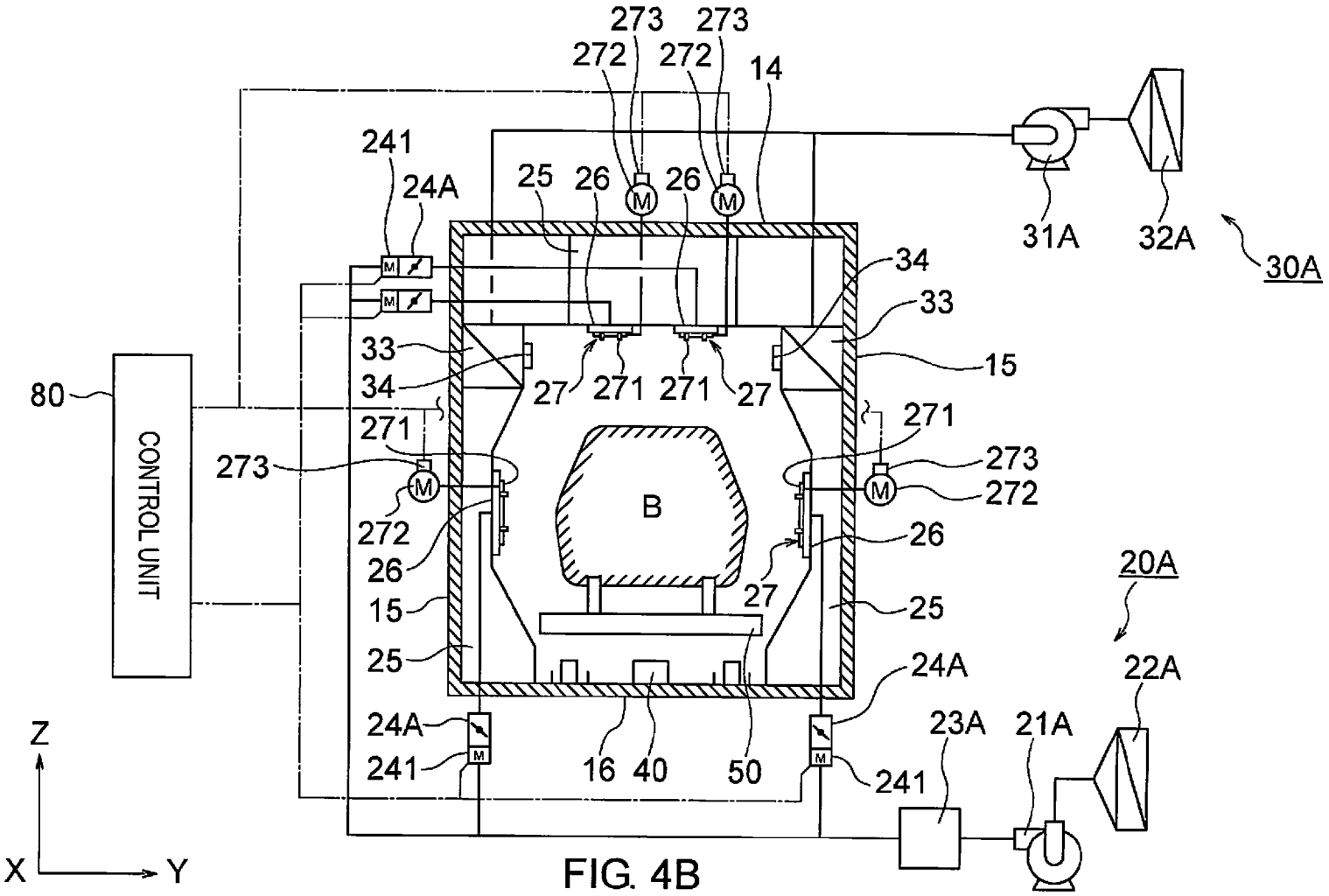
FIG. 4B is a front cross-sectional view illustrating a schematic overview of a local temperature raising region of the topcoat drying device according to one embodiment of the present invention.
Figure 4C:
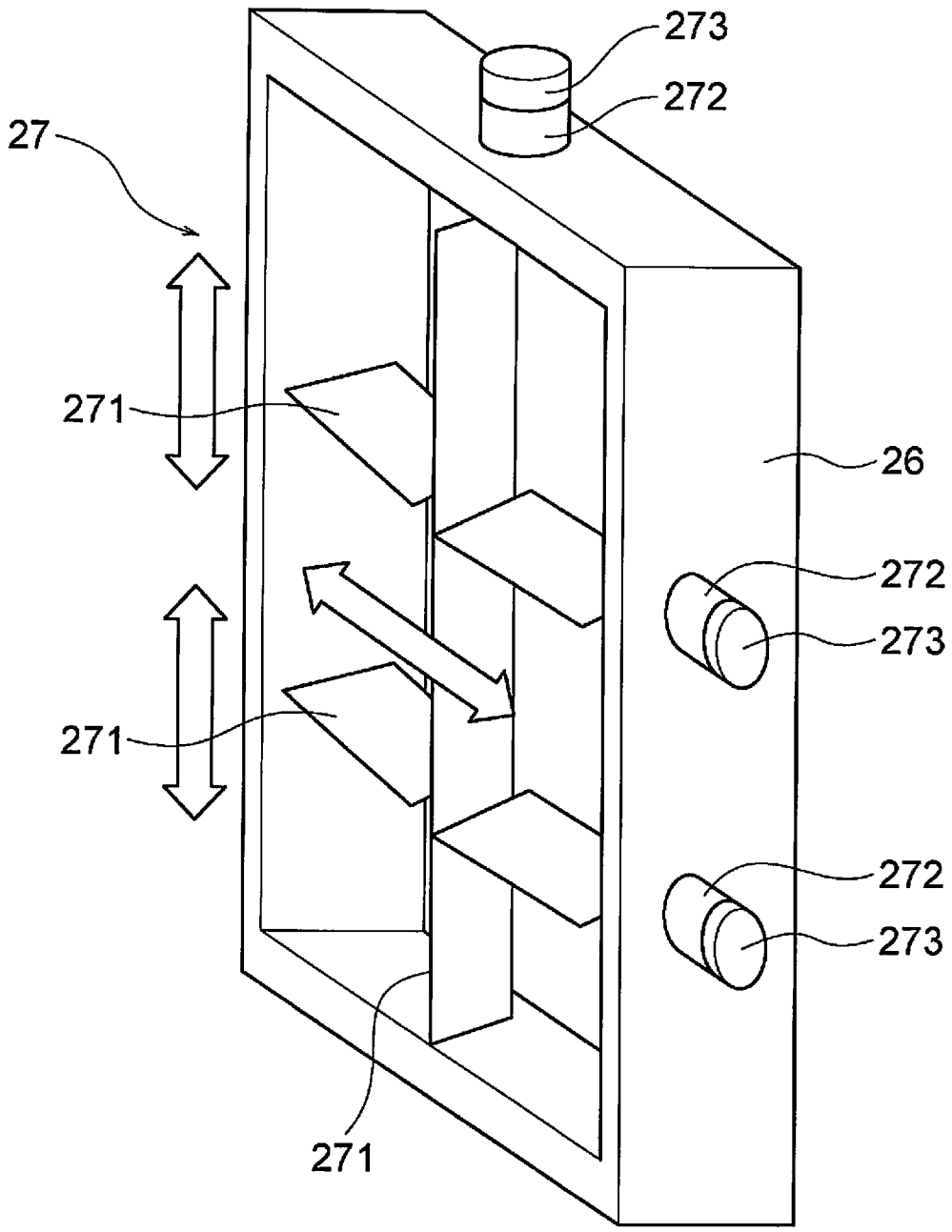
FIG. 4C is a perspective view illustrating a schematic overview of a first hot air outlet and a louver according to one embodiment of the present invention.

FIG. 4A is a side surface view illustrating a schematic overview of a topcoat drying device according to one embodiment of the present invention; FIG. 4B is a front cross-sectional view illustrating a schematic overview of a local temperature raising region of the topcoat drying device according to one embodiment of the present invention; FIG. 4C is a perspective view illustrating a schematic overview of a first hot air outlet and a louver according to one embodiment of the present invention; and FIG. 4D is a front cross-sectional view illustrating a schematic overview of a temperature raising region of the topcoat drying device according to one embodiment of the present invention.

Figure 4D:
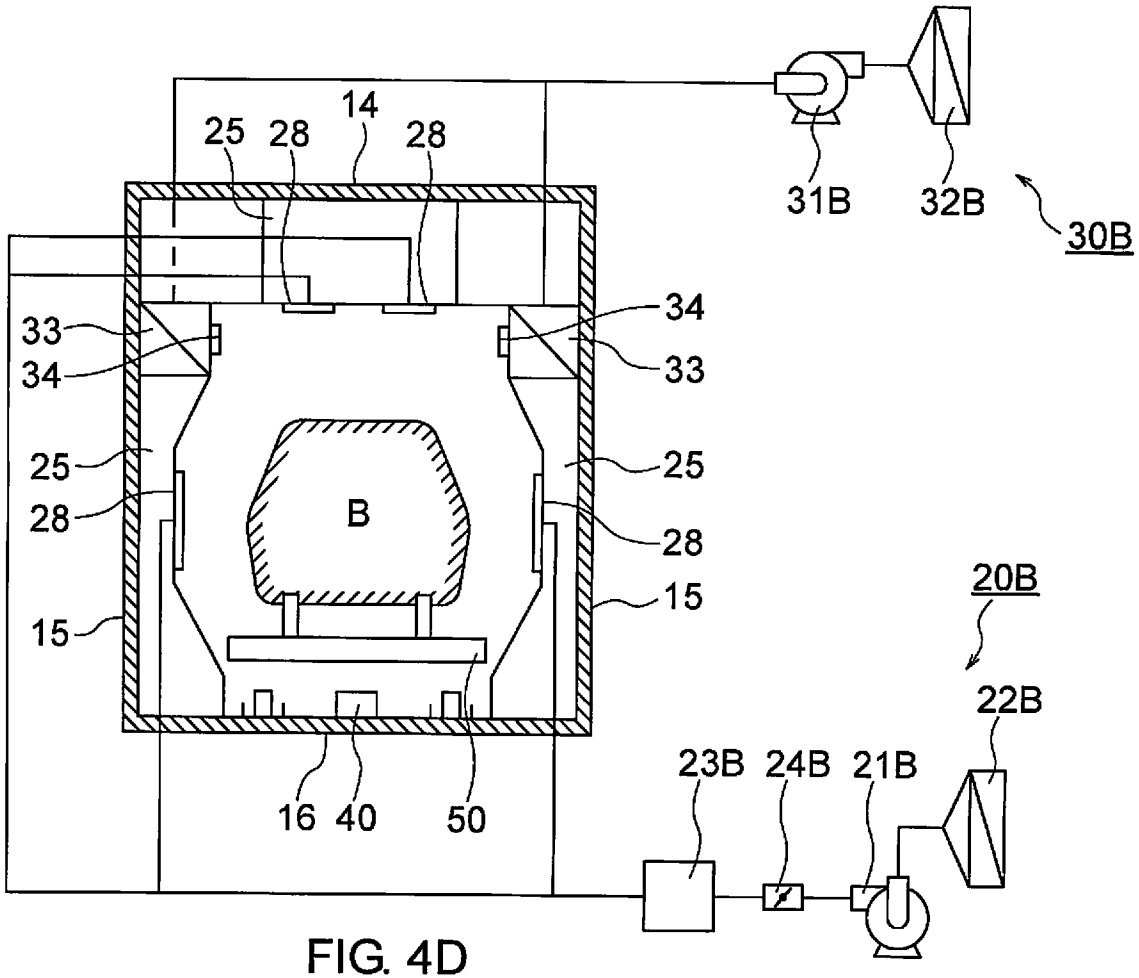
FIG. 4D is a front cross-sectional view illustrating a schematic overview of a temperature raising region and a holding region of a topcoat drying device according to one embodiment of the present invention.

The topcoat drying device 1 of the present embodiment comprises a drying furnace main body 10, hot air supply devices 20A-20C, exhaust apparatuses 30A-30C, a position detecting sensor 60, a vehicle type detecting sensor 70, and a control unit 80, as illustrated in FIG. 4A, FIG. 4B, and FIG. 4D. The drying furnace main body 10 of the present embodiment is dome-shaped and comprises an acclivitous portion 11 on the entrance side, a declivitous portion 13 on the exit side, and a raised floor portion 12 between the acclivitous portion 11 and the declivitous portion 13, as illustrated in the side surface view of FIG. 4A. Additionally, the drying furnace main body is a rectangular drying furnace having a ceiling surface 14, a pair of left and right side surfaces 15, 15, and a floor surface 16, as illustrated in the cross-sectional views of FIG. 4A and FIG. 4B. In the side surface view of FIG. 4A, the left side is the topcoat setting zone at the terminus of the topcoating booth and the entrance side of the drying furnace main body 10, and the right side is the exit side of the drying furnace main body 10; a coating object B that is mounted on the coating platform 50 is conveyed in a forward-looking manner from left to right in FIG. 4A. That is, the coating object B that is conveyed inside the topcoat drying device 1 of the present embodiment is conveyed in the right direction illustrated in FIG. 3A.

The height of the floor surface 16 of the raised floor portion 12 of the drying furnace main body 10 is substantially the same height as the height of the upper edge of the opening of the drying furnace main body 10 entrance and as the height of the upper edge of the opening of the drying furnace main body 10 exit. It is thereby possible to prevent the hot air that is supplied to the raised floor portion 12 from escaping outside of the drying furnace main body 10 from the entrance or the exit. A transport conveyor 40, which conveys the coating platform 50 on which is mounted the coating object B, is laid on the floor surface 16 of the drying furnace main body 10 along the direction in which the drying furnace main body 10 extends.

In the present embodiment, the raised floor portion 12 is substantially the heating region, and this raised floor portion 12 is configured comprising a local temperature raising region Z1, a temperature raising region Z2, and a temperature holding region Z3, as illustrated in FIG. 4A. The local temperature raising region Z1 is a region in which localized heating is carried out with respect to a part that has a relatively higher heat capacity (the bumper BP in the present embodiment) from among the coating objects B, which include parts with different heat capacities (the vehicle body B1 and the bumper BP in the present embodiment), in accordance with the heat capacity of said part. The temperature raising region Z2 is positioned on the downstream side of the local temperature raising region Z1 and is a region in which the coating object B is heated and the temperature thereof is raised to a heating temperature threshold Tc. The temperature holding region Z3 is positioned on the downstream side of the temperature raising region Z2 and is a region in which the temperature-raised coating object B is heated and the temperature of which is held at the heating temperature threshold Tc or greater for a predetermined time. Here, the heating temperature threshold Tc is set on the basis of the curing temperatures of the topcoat base paint and the topcoat clear paint that are used. In the present embodiment, the heating temperature threshold Tc is a value that is on the higher temperature side relative to the curing temperatures of the topcoat base paint and the topcoat clear paint by a predetermined temperature, and is specifically 130° C.-150° C.

Additionally, in the present embodiment, a hot air supply device 20A and an exhaust apparatus 30A are provided corresponding to the local temperature raising region Z1; a hot air supply device 20B and an exhaust apparatus 30B are provided corresponding to the temperature raising region Z2; and a hot air supply device 20C and an exhaust apparatus 30C are provided corresponding to the temperature holding region Z3. In the following description, first, the configuration of the topcoat drying device 1 in the local temperature raising region Z1 is described, and then the configurations of the temperature raising region Z2 and the temperature holding region Z3 will be described.

The hot air supply device 20A is an apparatus used to supply generated hot air into the raised floor portion 12 of the drying furnace main body 10 in the local temperature raising region Z1, comprising an air supply fan 21A, an air supply filter 22A, a burner 23A, an air volume damper 24A, an air supply duct 25, a first hot air outlet 26, and a louver 27, as illustrated in FIG. 4A. The "hot air supply device 20A" in the present embodiment corresponds to one example of the "heating means" of the present invention.

The air supply fan 21A is an apparatus for supplying air that is suctioned from the outside to the inside of the raised floor portion 12 of the drying furnace main body 10. The air supply filter 22A is connected to the suction side of the air supply fan 21A and filters the air that is suctioned from the outside to separate dust, etc. Clean air is thereby drawn into the air supply fan 21A. The burner 23A is connected to the discharge side of the air supply fan 21A and heats the air that is discharged from the air supply fan 21A to a predetermined temperature. The suctioned air is thereby supplied inside the raised floor portion 12 of the drying furnace main body 10 as hot air.

The air volume damper 24A in the present embodiment is provided corresponding to each of a plurality of first hot air outlets 26 and is positioned further toward the primary side than the first hot air outlets 26. It is possible to adjust the air volume of the hot air that is supplied to each of the first hot air outlets 26 by controlling the opening amount of this air volume damper 24A. The supply of hot air to the first hot air outlet 26 by the air supply fan 21A is stopped by cutting off said air volume damper 24A. Said air volume damper 24A comprises an actuator 241. While not particularly limited, the actuator 241 is, for example, a DC motor or the like. This actuator 241 electronically controls the opening amount of the air volume damper 24A based on a signal that is output from the control unit 80. The "air volume damper 24A" in the present embodiment corresponds to one example of the "airflow speed adjustment means" of the present invention.

The air supply duct 25 is disposed to each of the ceiling surface 14 and the left and right side surfaces 15, 15 of the raised floor portion 12 of the drying furnace main body 10 along the conveyance direction of the coating object B, as illustrated in FIG. 4B and FIG. 4D. In the present embodiment, while the air supply duct 25 is provided across the local temperature raising region Z1, the temperature raising region Z2, and the temperature holding region Z3, the temperature and the flow rate of the hot air that is drawn into each region is controlled by insulating the air supply duct 25 between each region and providing a hot air supply device corresponding to each region.

The first hot air outlet 26 is configured from a plurality of rectangular slits (openings), which are disposed at predetermined intervals along the direction in which extends the air supply duct 25, which is disposed inside the raised floor portion 12 of the drying furnace main body 10, as well as airflow direction plates, which are provided to the slits as needed. The first hot air outlet 26 is provided such that the opening or the airflow direction plate of each slit faces the central portion of the drying furnace main body 10, and the hot air that is supplied by the air supply fan 21A is thereby blown to the coating object B that is conveyed inside the drying furnace main body 10.

In the local temperature raising region Z1 of the present embodiment, first hot air outlets 26, 26 are provided to the ceiling surface 14 and the side surface 15 of the drying furnace main body 10, as illustrated in FIG. 4B. The first hot air outlet 26 provided to the left and right side surfaces 15, 15 of the drying furnace main body 10 is provided such that the opening or the airflow direction plate is oriented toward the outer panel portions of the vehicle body B1, such as the front fender B12, the side door D, the side sill B10, and the rear fender B14 when the coating object B passes in front of the first hot air outlet 26. In addition, the first hot air outlet 26 that is provided to the ceiling surface 14 is positioned such that the opening or the airflow direction plate is oriented toward the outer panel portions of the vehicle body B1, such as the hood F, the roof B16, and the back door BD, when the vehicle body B1 passes in front of the first hot air outlet 26. The "first hot air outlet 26" in the present embodiment corresponds to one example of the "hot air outlet" of the present invention.

In addition, a louver 27 is accordingly provided to each of the plurality of first hot air outlets 26 in the vicinity of the opening of the first hot air outlet 26. The louver 27 is used to deflect the flow direction of the hot air that is blown from the first hot air outlet 26 and comprises a slat 271, a deflection motor 272, and an angle sensor 273, as illustrated in FIG. 4C. The "louver 27" in the present embodiment corresponds to one example of the "hot air deflection means" of the present invention.

The slat 271 is configured comprising a vertical slat that extends in the vertical direction in the drawing and two lateral slats that extend in the lateral direction of the drawing, as illustrated in FIG. 4C. In the louver 27 of the left and right side surfaces 15, 15 illustrated in FIG. 4B, the vertical slat is provided along the Z direction of the drawing, and the lateral slats are provided along the Y direction of the drawing. In addition, in the louver 27 provided to the ceiling surface 14 illustrated in FIG. 4B, the vertical slat is provided along the Y direction of the drawing, and the lateral slats are provided along the X direction of the drawing. The configuration of the slat 271 is not particularly limited to the foregoing.

The angle of the slat 271 can be changed with respect to the flow direction of the hot air blown from the first hot air outlet 26, and the flow direction of the hot air can be deflected by causing the hot air blown from the first hot air outlet 26 to impact this slat 271. This slat 271 is oriented in a direction that does not substantially deflect the flow direction of the hot air blown from the first hot air outlet 26 during normal times.

The deflection motor 272 is not particularly limited and is an actuator such as a DC motor. This deflection motor 272 is connected to the slat 271 and electronically controls the angle of the slat 271 based on a signal that is output from the control unit 80, as illustrated in FIG. 4B and FIG. 4C. The angle sensor 273 detects the angle of rotation of the rotor of the deflection motor 272, which operates based on a command from the control unit 80, and the angle of the slat 271 is inferred based on the detection result of said angle sensor 273. In addition, when deflection motor 272 operates based on a signal from the control unit 80 and the rotor of the deflection motor 272 reaches a predetermined angle of rotation, the angle sensor 273 outputs a detection signal to the control unit 80.

In the present embodiment, the deflection motor 272 and the angle sensor 273 are provided to correspond to each slat 271. That is, a total of three each of the deflection motors 272 and angle sensors 273 are provided to the louver 27 of the present embodiment. The deflection motor 272 and the angle sensor 273 are not particularly limited so long as it is possible to detect the operation of the actuator. For example, cylinders, etc., that utilize air pressure or oil pressure may be used instead of a deflection motor 272. In this case, a position sensor that detects the plunger position inside the cylinder may be used instead of an angle sensor.

The exhaust apparatus 30A as illustrated in FIG. 4A and FIG. 4B is an apparatus for discharging the solvent that evaporates inside the drying furnace main body 10 to the outside of the system and comprises an exhaust fan 31A, an exhaust filter 32A, an exhaust duct 33, and an exhaust inlet 34. The exhaust fan 31A draws the hot air from the interior of the drying furnace main body 10 and discharges same to the outside of the drying furnace main body 10 or circulates same to the primary side of the hot air supply device 20A, and is responsible for the function of adjusting the hot air pressure and removing dust, etc., from the interior of the drying furnace main body 10. The exhaust filter 32A is provided on the discharge side of the exhaust fan 31A. The hot air is drawn by the exhaust fan 31A, passes through the exhaust filter 32A, and is discharged to the outside of the system or returned to the hot air supply device 20A. The exhaust duct 33 is provided to each of the left and right side surfaces 15, 15 of the drying furnace main body 10 along the conveyance direction of the coating object B. The exhaust inlet 34 is made up of slits formed, at predetermined intervals, to the exhaust duct 33, which is disposed inside the drying furnace main body 10. The exhaust apparatus 30B provided corresponding to the temperature raising region Z2 and the exhaust apparatus 30C provided corresponding to the temperature holding region Z3 described below have the same configuration as the exhaust apparatus 30A, and thus the descriptions thereof will be omitted.

In the temperature raising region Z2, a hot air supply device 20B is provided corresponding to the temperature raising region Z2, as illustrated in FIG. 4D. The hot air supply device 20B comprises an air supply fan 21B, an air supply filter 22B, a burner 23B, an air volume damper 24B, an air supply duct 25, and a second hot air outlet 28; however, since the air supply fan 21B, the air supply filter 22B, and the burner 23B have the same configurations as the air supply fan 21A, the air supply filter 22A, and the burner 23A, the descriptions thereof are omitted. The air volume damper 24B is provided between the air supply fan 21B and the burner 23B and collectively adjusts the air volume of the hot air that is supplied to the second hot air outlet 28.

The second hot air outlets 28, 28 are provided to the ceiling surface 14 and the side surface 15 of the drying furnace main body 10. The second hot air outlets 28, 28 provided to the left and right side surfaces 15, 15 of the drying furnace main body 10 are positioned such that the opening or the airflow direction plate is oriented toward the bumper BP and the outer panel portions of the vehicle body B1, such as the front fender B12, the side door D, the side sill B10, and the rear fender B14, when the coating object B passes in front of the second hot air outlet 28. In addition, the second hot air outlet 28 that is provided to the ceiling surface 14 is positioned such that the opening or the airflow direction plate is oriented toward the bumper BP and the outer panel portions of the vehicle body B1, such as the hood F, the roof B16, and the back door BD, when the vehicle body B1 passes in front of the second hot air outlet 28. Hot air is blown to the entire coating object B by such a second hot air outlet 28, and the entire coating object B is heated and the temperature thereof is raised. In the present embodiment, the flow speed of the hot air that is supplied from the second hot air outlet 28 to the drying furnace main body 10 by the hot air supply apparatus 20B shall be the standard airflow speed.

In the temperature holding region Z3, a hot air supply device 20C is provided corresponding to the temperature holding region Z3. Since the hot air supply device 20C has the same configuration as the above-described hot air supply device 20B, the description thereof will be omitted. In said temperature holding region Z3, hot air is blown over the entire coating object B via the second hot air outlet 28, and the temperature of the entire coating object B, which was raised by passing through the temperature raising region Z2, is maintained.

The position detecting sensor 60 is used to detect the position of the coating object B before the coating object B is conveyed inside the drying furnace main body 10 and comprises a limit switch (hereinafter sometimes referred to as "LS") 61, and a contact 62, as illustrated in FIG. 4A. The LS 61 is disposed on the upstream side of the drying furnace main body 10 and is provided on the side of the transport conveyor 40 so as to not interfere with the coating platform 50. Said LS 61 comprises a sensor (not shown) that incorporates a microswitch and a lever mechanism (not shown) for actuating the microswitch. This lever mechanism is provided so as to face the central axis side of the transport conveyor 40.

The contact 62 is provided on the side of the coating platform 50 (specifically the base 51) and opposes the lever mechanism of the LS 61. In the present embodiment, the position of the coating platform 50 is detected by conveying the coating platform 50 with the transport conveyor 40 and bringing the lever mechanism of the LS 61 into contact with the contact 62, thereby placing the microswitch in the ON state. The position of the coating object B that is mounted on the coating platform 50 is then inferred on the basis of the detection result of said position detecting sensor 60. In addition, when the position of the coating platform 50 is to be detected, the position detecting sensor 60 outputs a detection signal to the control unit 80. The configuration of the position detecting sensor 60 is not limited to the foregoing description. Additionally, a conveyor drive signal from a control unit of the transport conveyor 40 is input to the control unit 80 along with the position detection signal of the coating platform 50, which is detected by the position detecting sensor 60. The "position detecting sensor 60" in the present embodiment corresponds to one example of the "position detecting means" of the present invention.

The vehicle type detecting sensor 70 comprises a production management receiver 71 and a production management transmitter 72, as illustrated in FIG. 4A. The production management receiver 71 is disposed on the upstream side of the drying furnace main body 10, and is provided on the side of the transport conveyor 40 so as to not interfere with the coating platform 50. The production management transmitter 72 is provided on the side of the coating platform 50 (specifically the base 51) so as to approach the production management receiver 71 when the coating platform 50 passes through. Specification information relating to the specification of the coating object B that is mounted on the coating platform 50 is prestored in the production management transmitter 72. The production management receiver 71 is configured to read the specification information from the production management transmitter 72 and obtain specification information on the coating object B when the coating platform 50 is conveyed by the transport conveyor 40 and the production management transmitter 72 and the production management receiver 71 approach each other. When the specification information on the coating object B is to be obtained, the vehicle type detecting sensor 70 outputs the specification information to the control unit 80 as an electronic signal. The configuration of the vehicle type detecting sensor 70 is not limited to the foregoing description. The "vehicle type detecting sensor 70" in the present embodiment corresponds to one example of the "coating object information acquisition means" of the present invention.

The control unit 80 in the present embodiment is a microcomputer configured comprising a CPU, ROM, RAM, A/D converter, and an input/output interface, etc., and is a control unit that controls the hot air supply apparatus 20A. Said control unit 80 controls the actuator 241 of the air volume damper 24A and the deflection motor 272 of the louver 27 based on signals that are output from the angle sensor 273, signals that are output from the position detecting sensor 60, and signals that are output from the vehicle type detecting sensor 70. In the present embodiment, a plurality of louvers 27 and air volume dampers 24A are provided corresponding to the plurality of first hot air outlets 26, and the control unit 80 independently controls each of the plurality of air volume dampers 24A and the plurality of louvers 27. In this manner, the control unit 80 carries out a control to heat and raise the temperature according to the heat capacity of each part in order to prevent overheating of parts that have a relatively low heat capacity (vehicle body B1) from among the coating objects B, which include parts having different heat capacities (vehicle body B1 and bumper BP) in the local temperature raising region Z1. The control procedure by the control unit 80 will be described below.

Figure 5:
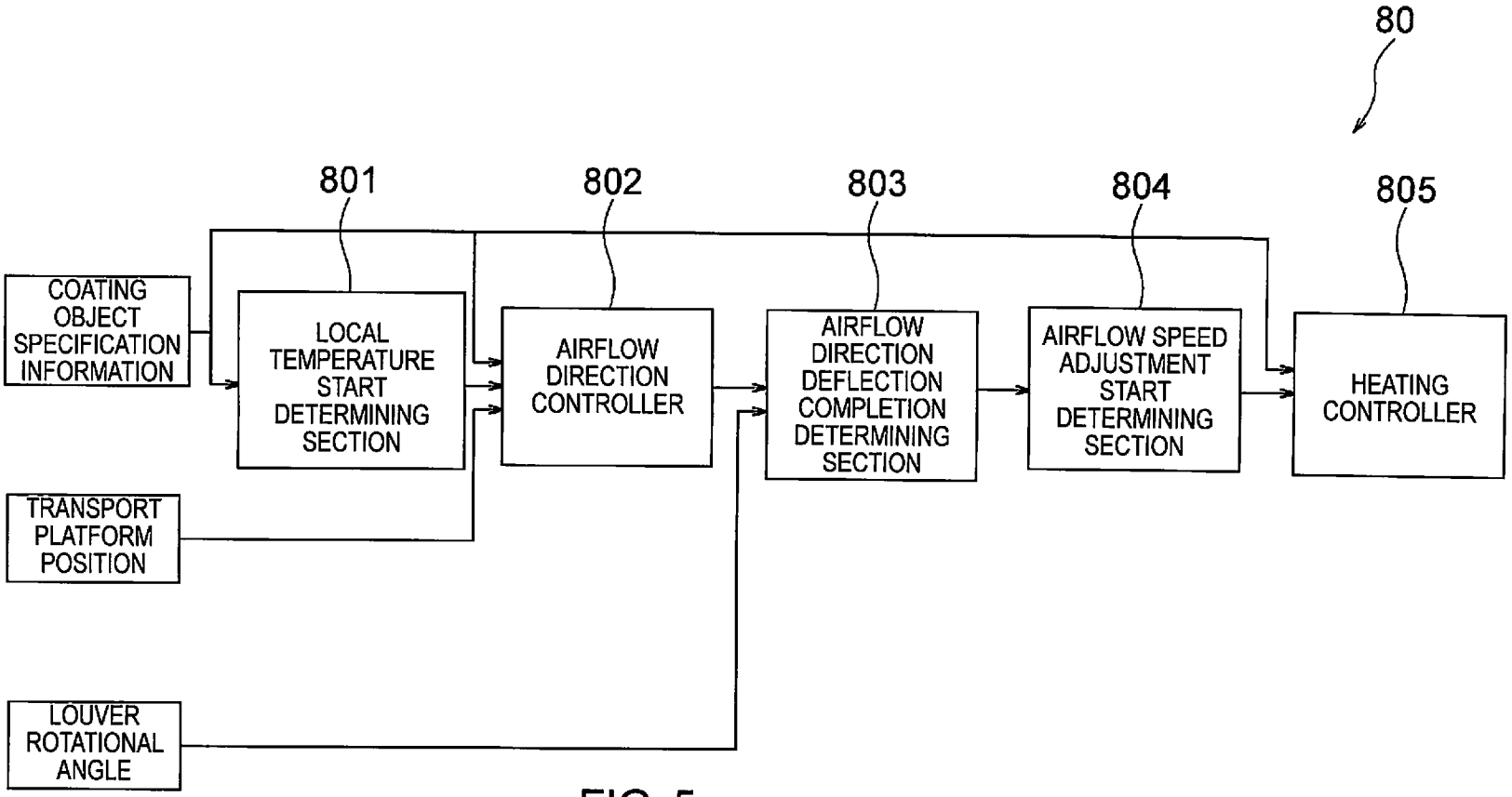
FIG. 5 is a block diagram illustrating a control unit according to one embodiment of the present invention.

FIG. 5 is a block diagram illustrating a control unit according to one embodiment of the present invention.

This control unit 80 comprises a local temperature increase start determining section 801, an airflow direction controller 802, an airflow direction deflection completion determining section 803, an airflow speed adjustment start determining section 804, and a heating controller 805, as illustrated in FIG. 5. The coating object specification information, coating platform position, and louver angle of rotation on the leftmost column of FIG. 5 indicate input parameters, which are detected by the various components of the topcoat drying device 1 described above.

The "airflow direction controller 802" in the present embodiment corresponds to one example of the "airflow direction control means" of the present invention, the "airflow direction deflection completion determining section 803" in the present embodiment corresponds to one example of the "airflow direction deflection completion determining means" of the present invention, the "airflow speed adjustment start determining section 804" in the present embodiment corresponds to one example of the "heating control start determining means" and the "airflow speed adjustment start determining means" of the present invention, and the "heating controller 805" in the present embodiment corresponds to one example of the "heating control means" of the present invention.

The local temperature increase start determining section 801 determines whether or not to start a local temperature increase heating control based on the specification information of the coating object B that is output from the vehicle type detecting sensor 70. Additionally, when it is determined that a local temperature increase heating control is to be started, the local temperature increase start determining section 801 outputs the corresponding signal to the airflow direction controller 802.

When it is determined by the local temperature increase start determining section 801 that a local temperature increase heating control is to be started, the airflow direction controller 802 identifies the installation location of the bumper BP based on the specification information of the coating object B that is output from the vehicle type detecting sensor 70. The airflow direction controller 802 then deflects the flow direction of the hot air blown from the first hot air outlet 26 based on the position of the bumper BP and the position of the first hot air outlet 26. The position of the bumper BP is calculated using a predetermined arithmetic expression and is based on the position of the coating platform 50 that is output from the position detecting sensor 60, the conveying speed of the transport conveyor 40 (conveyor drive signal), and the installation position of the bumper BP obtained from the specification information of the coating object B. The flow direction of the hot air can be deflected by controlling the operation of the deflection motor 272 of the louver 27 with the airflow direction controller 802. When deflecting the flow direction of the hot air, the airflow direction controller 802 outputs a corresponding signal to the airflow direction deflection completion determining section 803.

When the flow direction of the hot air is to be deflected by the airflow direction controller 802, the airflow direction deflection completion determining section 803 determines whether or not the deflection of the flow direction of the hot air has been completed based on the detection result that is output by the angle sensor 273 of the louver 27. In addition, when it is determined that the deflection of the flow direction of the hot air has been completed, the airflow direction deflection completion determining section 803 outputs a corresponding signal to the airflow speed adjustment start determining section 804.

When it is determined that the deflection of the flow direction of the hot air has been completed by the airflow direction deflection completion determining section 803, the airflow speed adjustment start determining section 804 determines to start an adjustment of the flow speed of the hot air blown from the first hot air outlet 26. When it is determined that an adjustment of the flow speed of the hot air is to be started, the airflow speed adjustment start determining section 804 outputs a corresponding signal to the heating controller 805.

When it is determined by the airflow speed adjustment start determining section 804 that an adjustment of the flow speed of the hot air is to be started, the heating controller 805 adjusts the opening amount of the air volume damper 24A and adjusts the flow speed of the hot air blown from the first hot air outlet 26 that corresponds to the air volume damper 24A based on the specification information of the coating object B that is output from the vehicle type detecting sensor 70. Specifically, said heating controller 805 increases the flow speed of the hot air blown from the first hot air outlet 26 when a bumper BP with high heat capacity passes in front of the first hot air outlet 26, and reduces the flow speed of the hot air or sets the flow speed of the hot air blown from the first hot air outlet 26 to the standard airflow speed when a vehicle body B1 with low heat capacity passes in front of the first hot air outlet 26. The vehicle body B1 is suppressed from undergoing thermal deformation due to overheating by reduction of the flow speed of the hot air that is blown onto the vehicle body B1 with low heat capacity.

When the flow speed of the hot air is to be increased, the heating controller 805 outputs an instruction to the actuator 241 to increase the opening amount of the air volume damper 24A corresponding to the first hot air outlet 26 which blows hot air at a high airflow speed. When the flow speed of the hot air is to be reduced, the heating controller 805 outputs an instruction to the actuator 241 to decrease the opening amount of the air volume damper 24A corresponding to the first hot air outlet 26 which blows hot air at a low airflow speed. At this time, the flow speed of the hot air that is increased and decreased takes on values that are set in advance based on the specification of the coating object B, and the heating controller 805 controls the operation of the actuator 241 so that the opening amount of the air volume damper 24A is adjusted to correspond to the preset value.

Next, the topcoat drying Step P62 in the present embodiment will be described with reference to FIG. 6A and FIG. 6B.

Figure 6A:
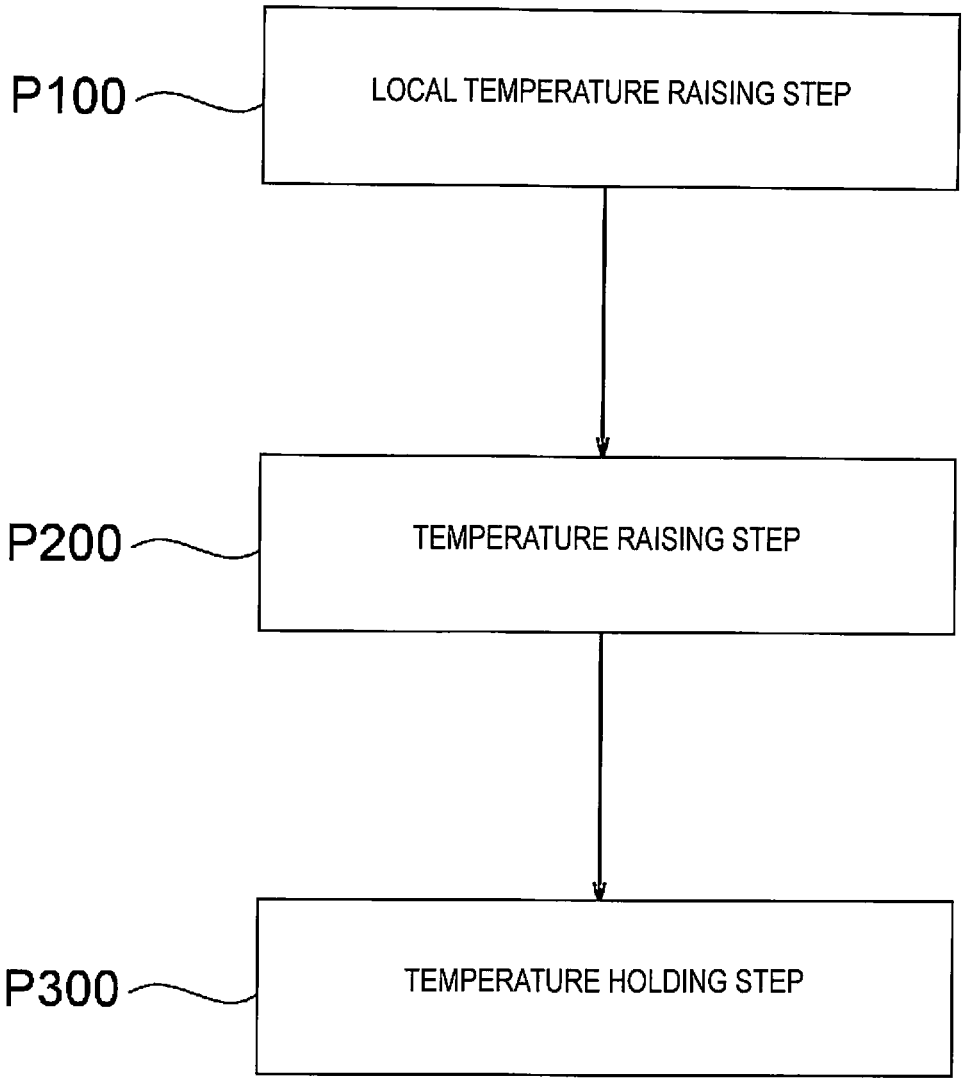
FIG. 6A is a process view illustrating a topcoat drying Step P62 according to one embodiment of the present invention.
Figure 6B:
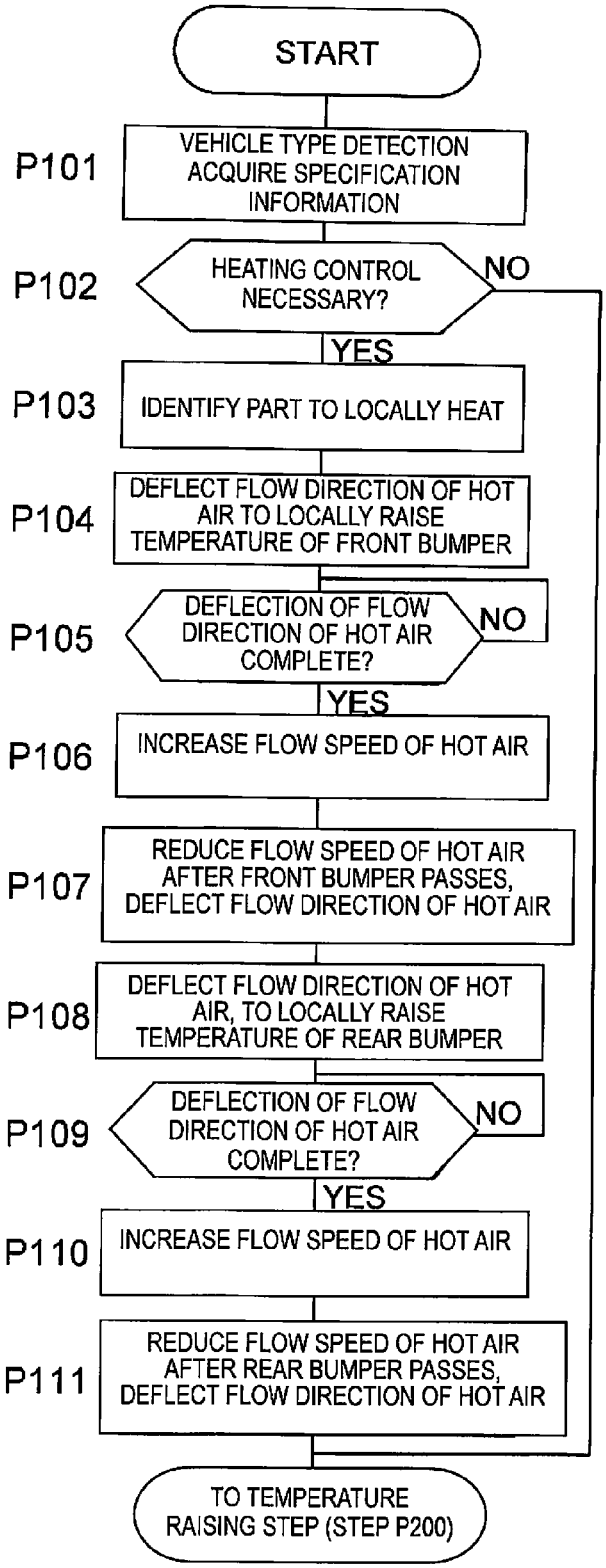
FIG. 6B is a flowchart illustrating a local temperature raising Step P100 according to one embodiment of the present invention.

FIG. 6A is a process view illustrating a topcoat drying Step P62 according to one embodiment of the present invention, and FIG. 6B is a flowchart illustrating a local temperature raising Step P100 according to one embodiment of the present invention.

This topcoat drying Step P62 comprises a local temperature raising Step P100, a temperature raising Step P200, and a temperature holding Step P300, as illustrated in FIG. 6A. First, the local temperature raising Step P100 will be described in detail with reference to FIG. 6B. This local temperature raising Step P100 is carried out by the execution of a topcoat drying control program that is installed in the control unit 80.

The local temperature raising Step P100 in the present embodiment is carried out with respect to a coating object B on which is formed a top coated film during the top coating Step P61 described above. First, in Step P101, the specification information of the coating object B, which is mounted on the coating platform 50, is acquired by the vehicle type detecting sensor 70. Then, when the specification information of the coating object B is obtained, the vehicle type detecting sensor 70 outputs the specification information to the local temperature increase start determining section 801 of the control unit 80 as an electronic signal.

In Step P102, the local temperature increase start determining section 801 determines whether or not to start a local temperature increase heating control based on the specification information of the coating object B. If the local temperature increase start determining section 801 determines that a local temperature increase heating control is to be started, process control proceeds to Step P103. On the other hand, if the local temperature increase start determining section 801 determines that a local temperature increase heating control is not to be started, process control proceeds to the temperature raising Step P200. If the local temperature increase start determining section 801 determines that a control of the hot air is not to be started, the slat 271 is oriented in the direction of the normal time and blows hot air from the first hot air outlet 26 at a standard airflow speed. That is, the coating object B is heated and the temperature thereof is raised in the local temperature raising region Z1 under the same condition as when the object is in the temperature raising region Z2.

In Step P103, if it was determined by the local temperature increase start determining section 801 that a control of the hot air is to be started, the airflow direction controller 802 identifies the installation location of the bumper BP (front bumper BP1 and rear bumper BP2) based on the specification information of the coating object B that is output from the vehicle type detecting sensor 70.

In Step P104, the airflow direction controller 802 deflects the flow direction of the hot air blown from the first hot air outlet 26 based on the position of the front bumper BP1 and the position of the first hot air outlet 26. The position of the front bumper BP1 is calculated in advance using a predetermined arithmetic expression and is based on the position of the coating platform 50 that is output from the position detecting sensor 60, the conveying speed of the transport conveyor 40, and the installation position of the front bumper BP1. The airflow direction controller 802 deflects the flow direction of the hot air by controlling the slat 271 with the deflection motor 272 of the louver 27. In this manner, it is possible to locally heat and raise the temperature of the front bumper BP1 by deflecting the flow direction of the hot air toward the front bumper BP1 with a high heat capacity.

In Step P105, the airflow direction deflection completion determining section 803 determines whether or not the deflection of the flow direction of the hot air blown from the first hot air outlet 26 has been completed based on the detection signal that is output from the angle sensor 273 of the louver 27. If the airflow direction deflection completion determining section 803 determines that the deflection of the flow direction of the hot air has been completed, process control proceeds to Step P106. If the airflow direction deflection completion determining section 803 determines that the deflection of the flow direction of the hot air has not been completed, process control returns to Step P105.

In Step P106, if it was determined that the deflection of the flow direction of the hot air has been completed by the airflow direction deflection completion determining section 803, the airflow speed adjustment start determining section 804 determines to start an adjustment of the flow speed of the hot air blown from the first hot air outlet 26. Then, once the airflow speed adjustment start determining section 804 determines to start an adjustment of the flow speed of the hot air, the heating controller 805 outputs an instruction to increase the opening amount of the air volume damper 24A to the actuator 241 and to increase the flow speed of the hot air blown from the first hot air outlet 26. In this manner, when heating the front bumper BP1 with a high heat capacity, the front bumper BP1 is locally heated and the temperature thereof is raised by supplying hot air with a high amount of heat.

In Step P107, since the vehicle body B1 with a low heat capacity passes in front of the first hot air outlet 26 after the front bumper BP1 with a high heat capacity has passed in front of the first hot air outlet 26, the flow speed of the hot air blown from the first hot air outlet 26 is set to a standard airflow speed or the flow speed of the hot air is reduced. Then, the deflection motor 272 of the louver 27 is operated and the direction of the slat 271 is changed to deflect the flow direction of the hot air to the standard airflow direction. Hot air is thereby blown to the outer panel portion of the vehicle body B1, and the vehicle body B1 is heated and the temperature thereof is raised.

In Step P108, the airflow direction controller 802 deflects the flow direction of the hot air blown from the first hot air outlet 26 based on the position of the rear bumper BP2 and the position of the first hot air outlet 26. The position of the rear bumper BP2 is calculated in advance using a predetermined arithmetic expression and is based on the position of the coating platform 50 that is output from the position detecting sensor 60, the conveying speed of the transport conveyor 40, and the installation position of the rear bumper BP2. The installation position of the rear bumper BP2 is obtained based on the specification information of the coating object B that is output from the vehicle type detecting sensor 70.

In this Step P108, specifically, the airflow direction controller 802 deflects the flow direction of the hot air by controlling the slat 271 with the deflection motor 272 of the louver 27. In this manner, it is possible to locally heat and raise the temperature of the rear bumper BP2 by deflecting the flow direction of the hot air toward the rear bumper BP2 with a high heat capacity. Additionally, at this time, the airflow direction controller 802 changes the direction of the slat 271 such that the flow direction of the hot air is deflected along the conveyance direction of the coating platform 50. That is, the rear bumper BP2 is prevented from passing in front of the first hot air outlet 26 while the slat 271 is being operated by controlling the slat and deflecting the flow direction of the hot air from the upstream side to the downstream side.

In Step P109, the airflow direction deflection completion determining section 803 determines whether or not the deflection of the flow direction of the hot air blown from the first hot air outlet 26 has been completed based on the detection signal that is output from the angle sensor 273 of the louver 27. If the airflow direction deflection completion determining section 803 determines that the deflection of the flow direction of the hot air has been completed, process control proceeds to Step P110. If the airflow direction deflection completion determining section 803 does not determine that the deflection of the flow direction of the hot air has been completed, process control returns to Step P109.

In Step P110, if it was determined that the deflection of the flow direction of the hot air has been completed by the airflow direction deflection completion determining section 803, the airflow speed adjustment start determining section 804 determines to start an adjustment of the flow speed of the hot air blown from the first hot air outlet 26. Then, once the airflow speed adjustment start determining section 804 determines to start an adjustment of the flow speed of the hot air, the heating controller 805 outputs an instruction to increase the opening amount of the air volume damper 24A to the actuator 241 and to increase the flow speed of the hot air blown from the first hot air outlet 26.

In this manner, when heating the rear bumper BP2 with a high heat capacity, the rear bumper BP2 is locally heated and the temperature thereof is raised by supplying hot air with a high amount of heat. In addition, in the present embodiment, when changing the object of heating and temperature increase from the vehicle body B1 with a low heat capacity to the rear bumper BP2 with a high heat capacity, the flow speed of the hot air is increased after deflecting the flow direction of the hot air.

In Step P111, the flow speed of the hot air blown from the first hot air outlet 26 is set to the standard airflow speed after the rear bumper BP2 with a high heat capacity has passed in front of the first hot air outlet 26. Then, the deflection motor 272 of the louver 27 is operated and the direction of the slat 271 is changed to deflect the flow direction of the hot air to the standard airflow direction. Then, the device is put on standby until the next coating object B is conveyed in front of the first hot air outlet 26. The local temperature raising Step P100 is thus completed, and process control proceeds to the temperature raising Step P200.

In the temperature raising Step P200, the entire coating object B is heated and the temperature thereof is raised to a heating temperature threshold Tc or greater. In the local temperature raising Step P100, hot air with a relatively high amount of heat is supplied to the bumper BP with a high heat capacity, so that the difference in the temperature raising times of each part in a coating object B that includes parts having different heat capacities. In the temperature holding Step P300, the coating object B is held in the above-described temperature condition for 15-30 minutes. A top coated film is thereby baked and dried on the coating object B. The topcoat drying Step P62 of the present embodiment is thereby completed.

The topcoat drying device 1 in the present embodiment exerts the following effects.

(1) In the present embodiment, upon heating by blowing hot air onto a coating object B, which includes a vehicle body B1 and a bumper BP with a relatively high heat capacity, when heating the bumper BP, hot air is supplied with a greater airflow speed than the flow speed of the hot air that is supplied to heat the vehicle body B1. Accordingly, the difference between the temperature raising time of the vehicle body B1 and the temperature raising time of the bumper BP is reduced. As a result, it is possible to suppress the energy consumption required to raise the temperature of the vehicle body B1 and thereby achieve energy conservation. In addition, since the entire length of the drying furnace main body 10 is reduced, it is possible to reduce capital investment.

(2) Additionally, in the present embodiment, it is possible to locally heat and raise the temperature of the bumper BP more easily by deflecting the flow direction of the hot air toward the bumper BP with a high heat capacity, thereby reducing the temperature raising time of the bumper BP, and further reducing the difference between the temperature raising time of the vehicle body B1 and the temperature raising time of the bumper BP. As a result, it is possible to further reduce the energy consumption required to raise the temperature of the coating object B.

(3) In addition, in the present embodiment, when changing the object of heating and temperature increase from the vehicle body B1 to the rear bumper BP2, the orientation of the slat 271 is changed such that the flow direction of the hot air is deflected along the conveyance direction of the coating platform 50. It is thereby possible to prevent the rear bumper BP2 from passing in front of the first hot air outlet 26 while the orientation of the slat 271 is being changed.

(4) Additionally, in the present embodiment, when heating the bumper BP with a high heat capacity, the temperature raising time of the bumper BP is reduced by increasing the flow speed of the hot air and supplying hot air with a relatively high amount of heat. Since the entire length of the drying furnace main body 10 is thereby reduced, it is possible to reduce capital investment.

(5) In addition, in the present embodiment, when changing the object of heating and temperature increase from the vehicle body B1 with a low heat capacity to the rear bumper BP2 with a high heat capacity, the flow speed of the hot air is increased after deflecting the flow direction of the hot air to supply hot air with a relatively high amount of heat. Overheating of the vehicle body B1 is thereby prevented, and it is possible to improve the coating quality of the automobile that is made by assembling the vehicle body B1.

(6) Additionally, in the present embodiment, when the vehicle body B1 with a low heat capacity passes through the coating line, it is possible to suppress the over-baking of the coated film that is coated on the outer panel of the vehicle body B1 by reducing the flow speed of the hot air blown from the first hot air outlet 26, which the vehicle body B1 passes besides. It is thereby possible to further improve the coating quality of the automobile that is made by assembling the vehicle body B1.

(7) In addition, in the present embodiment, it is possible to heat and raise the temperature of the coating object B under appropriate conditions by independently controlling each of the plurality of air volume dampers 24A and the plurality of louvers 27, which are provided corresponding to the plurality of the first hot air outlets 26, with the control unit 80. As a result, it is possible to uniformly dry the top coated film of the coating object B.

(8) In addition, in the present embodiment, the vehicle body B1 and the bumper BP of the coating object B are mounted on the coating platform 50 such that the positional relationship therebetween is substantially matched with the finished vehicle which has completed the outfitting step, and the vehicle body B1 and the bumper BP are subjected to topcoating at the same time. It is thereby possible to suppress an occurrence of hue shift between the vehicle body B1 and the bumper BP and to obtain an automobile with an excellent appearance.

(9) Additionally, in the present embodiment, it is possible to dispense with a separate finish coating step carried out solely for the bumper BP and integrate same with the top coating Step P6 of the coating line PL by subjecting the vehicle body B1 and the bumper BP to topcoating at the same time. It is thereby possible to further reduce capital investment. In addition, since the vehicle body B1 and the bumper BP are not made into a lot, as in the prior art described above, and are passed through the coating line PL mounted on the same coating platform 50, it is possible to prevent production order dislocations.

The embodiments described above are described in order to facilitate understanding of the present invention and are not described in order to limit the present invention. Therefore, the elements disclosed in the embodiments above are intended to include all design modifications and equivalents thereto that lie within the technical range of the present invention.

For example, in the present embodiment, the coating objects B of the vehicle body that are conveyed to the coating line PL are all of the same vehicle type, but no limitation is imposed thereby, and the coating line may be a multi-model mixed line to which are conveyed different vehicle types.

In addition, in the present embodiment, a bumper BP is mounted on the coating platform 50 as the resin member, but no limitation is imposed thereby, and the resin member may be one type or two or more types selected from air spoilers, door mirror covers, front grills, various finishers, and door fasteners.

Additionally, in the present embodiment, a metal material such as steel is used as the material that forms the vehicle body B1, and a resin material is used as the material that forms the bumper BP, but no limitation is imposed thereby. For example, as long as the materials have different heat capacities, resin materials may be used in either of the material that forms the vehicle body B1 and the material that forms the bumper BP.

In addition, in the present embodiment, the vehicle body B1 is the first part and the bumper BP is the second part, but no limitation is imposed thereby. For example, when the vehicle body B1 is formed comprising materials with different heat capacities, the material with a low heat capacity of the materials that form the vehicle body B1 may be the first part, and the material with a high heat capacity of the materials that form the vehicle body B1 may be the second part. Specifically, while not particularly limited, for example, the first part may be steel, and the second part may be aluminum.

The invention claimed is:

1. A coat drying device for drying coated film coated onto a continuously transported coating object, the coating object comprising a first part and a second part having a greater heat capacity than a heat capacity of the first part, and at least the first part and the second part being conveyed by the same coating platform, and the coat drying device comprising:

a drying furnace inside of which the coating object is conveyed;

a hot air supply device that heats the coating object by supplying hot air into the drying furnace and blowing out the hot air from a hot air outlet to the inside of the drying furnace; and a heating control unit that controls the hot air supply device according to a heat capacity of the coating object, the hot air supply device comprising a hot air deflector that is provided in a vicinity of the hot air outlet and deflects a flow direction of the hot air that is blown out from the hot air outlet, and the heating control unit controls the hot air supply device such that, when heating the second part of the coating object that is conveyed, the flow direction of the hot air that is blown out from the hot air outlet is deflected from the first part to the second part to supply the hot air with a greater amount of heat than an amount of heat of the hot air that is supplied to heat the first part.

2. The coat drying device according to claim 1, wherein the coat drying device further comprises a position detecting sensor that detects a position of the first part and a position of the second part, and an airflow direction controller that controls the hot air deflector according to a position of the coating object, and the airflow direction controller controls the hot air deflector to deflect the flow direction of the hot air that is blown out from the hot air outlet, based on the detection result of the position detecting sensor and a position of the hot air outlet.

3. The coat drying device according to claim 2, wherein the airflow direction controller controls the hot air deflector such that, when heating the second part of the coating object that is conveyed, the flow direction of the hot air is deflected along a conveyance direction of the coating object.

4. The coat drying device according to claim 2, further comprising a coating object information acquisition device that acquires specification information relating to a specification of the coating object, wherein the airflow direction controller controls the hot air deflector to deflect the flow direction of the hot air that is blown out from the hot air outlet.

5. The coat drying device according to claim 2, further comprising an airflow direction deflection completion determining section that determines completion of deflection of the flow direction of the hot air by the hot air deflector, and a heating control start determining section that determines a start of a control of the hot air supply device by the heating control unit, when the airflow direction deflection completion determining section determines the completion of the deflection of the flow direction of the hot air.

6. The coat drying device according to claim 1, wherein the hot air supply device further comprises an airflow speed adjustment device that adjusts a flow speed of the hot air that is blown out of the hot air outlet, and the heating control unit controls the airflow speed adjustment device to supply hot air with a greater airflow speed than the flow speed of the hot air that is supplied to heat the first part, when heating the second part of the coating object that is conveyed.

7. The coat drying device according to claim 6, further comprising a coating object information acquisition device that acquires specification information relating to a specification of the coating object, wherein the heating control unit controls the airflow speed adjustment device to adjust the flow speed of the hot air that is blown from the hot air outlet.

8. The coat drying device according to claim 6, further comprising an airflow direction deflection completion determining section that determines completion of deflection of the flow direction of the hot air by the hot air deflector, and an airflow speed adjustment start determining section that determines a start of an adjustment of the flow speed of the hot air by the airflow speed adjustment device, when the airflow direction deflection completion determining section determines the completion of the deflection of the flow direction of the hot air.

9. A coat drying method for drying coated film coated onto a coating object that includes a first part, and a second having a greater heat capacity than a heat capacity of the first part, and at least the first part and the second part are continuously conveyed by the same coating platform, the coat drying method comprising:

conveying the coating object inside a drying furnace, heating the coating object using a hot air supply device that heats the coating object by supplying hot air into the drying furnace and blows out the hot air from a hot air outlet to the inside of the drying furnace, and controlling the hot air supply device using a heating control unit according to the heat capacity of the coating object, the controlling of the hot air supply device, when heating the second part of the coating object that is conveyed, supplies the hot air with a greater amount of heat to the second part than an amount of heat of the hot air that is supplied to heat the first part, after deflecting the flow direction of the hot air that is blown from the hot air outlet from the first part to the second part.

* * * * *